US009574382B2

(12) United States Patent
Behnke et al.

(10) Patent No.: US 9,574,382 B2
(45) Date of Patent: Feb. 21, 2017

(54) PULL HANDLE FOR A VEHICLE DOOR

(71) Applicant: D. La Porte Söhne GmbH, Wuppertal (DE)

(72) Inventors: Peter Behnke, Bochum (DE); Viktor Komkin, Wuppertal (DE)

(73) Assignee: D. La Porte Söhne GmbH, Wuppertal (DE)

( * ) Notice: Subject to any disclaimer, the term of this patent is extended or adjusted under 35 U.S.C. 154(b) by 185 days.

(21) Appl. No.: 14/506,980

(22) Filed: Oct. 6, 2014

(65) Prior Publication Data

US 2015/0096338 A1 Apr. 9, 2015

(30) Foreign Application Priority Data

Oct. 7, 2013 (DE) ..... 10 2013 016 607

(51) Int. Cl.

| | |
|---|---|
| ***E05B 13/00*** | (2006.01) |
| ***E05B 79/06*** | (2014.01) |
| ***E05B 85/16*** | (2014.01) |
| ***E05B 83/42*** | (2014.01) |
| ***E05B 85/06*** | (2014.01) |

(52) U.S. Cl.

CPC ..... *E05B 85/16* (2013.01); *E05B 79/06* (2013.01); *E05B 83/42* (2013.01); *E05B 85/06* (2013.01); *Y10T 70/5889* (2015.04); *Y10T 292/57* (2015.04)

(58) Field of Classification Search

CPC ..... E05B 79/00; E05B 79/02; E05B 79/04; E05B 79/06; E05B 85/06; E05B 85/10; E05B 85/14; E05B 85/16

See application file for complete search history.

(56) References Cited

U.S. PATENT DOCUMENTS 6,415,636 B1 * 7/2002 Fukumoto ..... B60J 5/0412 292/336.3
7,146,832 B2 * 12/2006 Mathofer ..... E05B 79/06 292/336.3
8,562,039 B2 * 10/2013 Ichikawa ..... E05B 85/16 292/336.3

(Continued)

FOREIGN PATENT DOCUMENTS

DE 103 43 355 A1 7/2004
DE 10 2006 012 956 A1 3/2007

(Continued)

OTHER PUBLICATIONS

German Examination Report—Jan. 29, 2015.
European Search Report—May 18, 2015.

*Primary Examiner* — Christopher Boswell
(74) *Attorney, Agent, or Firm* — Brinks Gilson & Lione

(57) ABSTRACT

A pull handle (1) for a lock of a vehicle door or lift gate featuring a pull handle housing (1*a*) having a bearing part (2) and a handle part (3) connected so as to swivel around a swivel axis between non-actuated and actuated positions. An actuation mechanism (4) mounted in the pull handle housing (1*a*) and can be actuated by the handle part (3). A coupling element (56) mounted in the pull handle housing (1*a*) couples with external lock elements. A locking mechanism (5) locks and unlocks the actuation mechanism (4). The coupling element is displaceable in the bearing part along an actuation axis (209), perpendicular to the swivel axis, and connected to the handle part (3) for linear movement in the actuation direction (204) parallel to the actuation axis (209).

36 Claims, 33 Drawing Sheets

(56) References Cited

U.S. PATENT DOCUMENTS

| | | | | |
|---|---|---|---|---|
| 8,746,758 | B2 * | 6/2014 | Savant | E05B 77/06 292/336.3 |
| 8,833,810 | B2 * | 9/2014 | Koizumi | E05B 77/06 292/336.3 |
| 8,959,964 | B2 * | 2/2015 | Hidaka | E05B 79/06 292/336.3 |
| 9,322,200 | B1 * | 4/2016 | Shimizu | E05B 85/16 |
| 2004/0113441 | A1 | 6/2004 | Lane et al. | |
| 2004/0227354 | A1 * | 11/2004 | Pantke | E05B 17/041 292/201 |
| 2008/0178646 | A1 | 7/2008 | Schwickerath | |
| 2009/0031768 | A1 | 2/2009 | Yamaguchi et al. | |
| 2009/0134638 | A1 | 5/2009 | Kutschat | |
| 2013/0233034 | A1 * | 9/2013 | Ono | E05B 79/06 70/101 |
| 2015/0096339 | A1 * | 4/2015 | Behnke | E05B 85/06 70/237 |
| 2015/0322699 | A1 * | 11/2015 | Ilardo | E05B 77/06 292/336.3 |

FOREIGN PATENT DOCUMENTS

| | | | |
|---|---|---|---|
| DE | 10 2008 007 322 | A1 | 8/2008 |
| EP | 1 079 048 | A1 | 2/2001 |
| EP | 1302613 | A1 | 4/2003 |
| JP | 2008-261129 | | 10/2008 |
| WO | 02/070840 | A2 | 9/2002 |

* cited by examiner

PULL HANDLE FOR A VEHICLE DOOR

CROSS-REFERENCE TO RELATED APPLICATIONS

This application claims priority to German Patent Application No. 10 2013 016 607.1, filed Oct. 7, 2013.

FIELD OF THE INVENTION

The present invention relates to a pull handle for releasing the lock of a vehicle door or lift gate, in particular a door or lift gate of an agricultural vehicle, e.g. a tractor, or of a construction machine.

BACKGROUND

Such a vehicle lock is referenced above is known, for example, from DE 10 2006 012 956 A1. This vehicle door lock features two rotary latches between which a locking bolt can be received. In the locked position of the vehicle door lock, the rotary latches enclose the locking bolt such that the vehicle door is held in its locked position. The two rotary latches are thereby held in their position by two pawls holding the locking bolt. The pawls namely lock the rotary latches. This locking can be undone by means of an actuating lever. The actuating lever engages into the lock box. A rotation of the actuating lever causes the pawls to release the rotary latches, which consequently release the locking bolt.

A vehicle door lock can thereby be unlocked, in the case of DE 10 2006 012 956 A1, the actuating lever can be actuated, for example, by means of a pressure knob or a pull handle. The pressure knob or the pull handle then features an actuation mechanism to release the lock, which, in the case of DE 10 2006 012 956 A1, is connected to the actuation lever. The actuation mechanism can thereby be unlocked and locked, for example, by means of a cylinder lock. If the actuation mechanism is blocked, the lock can no longer be unlocked, which is known per se.

A vehicle pull handle is known, for example, from DE 103 43 355 B4. This pull handle features a bearing housing with a mounting base plate, an actuation handle connected to the mounting base plate so as to swivel, as well as an actuation mechanism to release the rotary latch lock. The actuation handle is mounted on a pin, which is also mounted on the mounting base plate. A spring unit presses the actuation handle into its non-actuated normal position. The actuation mechanism of the pull handle has a connecting element, which is firmly connected to the actuation handle and thus rotates together with it on actuation. The connecting element engages in a recess in the bearing housing and the mounting base plate, and is in direct operative connection with the rotary latch lock. The pull handle also has a locking mechanism with a cylinder lock, by means of which the actuation mechanism can be locked. By rotating the cylinder using a matching key, a locking strip of the locking mechanism is brought into a position in which it blocks the movement of the actuation handle. Actuating the actuation handle is then no longer possible. The locking strip is thereby arranged outside the bearing housing.

The object of the present invention is to provide a pull handle for a vehicle door or lift gate, in particular a vehicle door or lift gate of an agricultural vehicle, for example, of a tractor or construction machine, which is functionally reliable and can easily be coupled to the lock.

This object is attained by a pull handle as described and claimed herein.

BRIEF DESCRIPTION OF THE DRAWINGS

The invention will be explained hereinafter in more detail, by way of example with reference to a drawing, which shows.

DETAILED DESCRIPTION OF THE INVENTION

Figure 1:
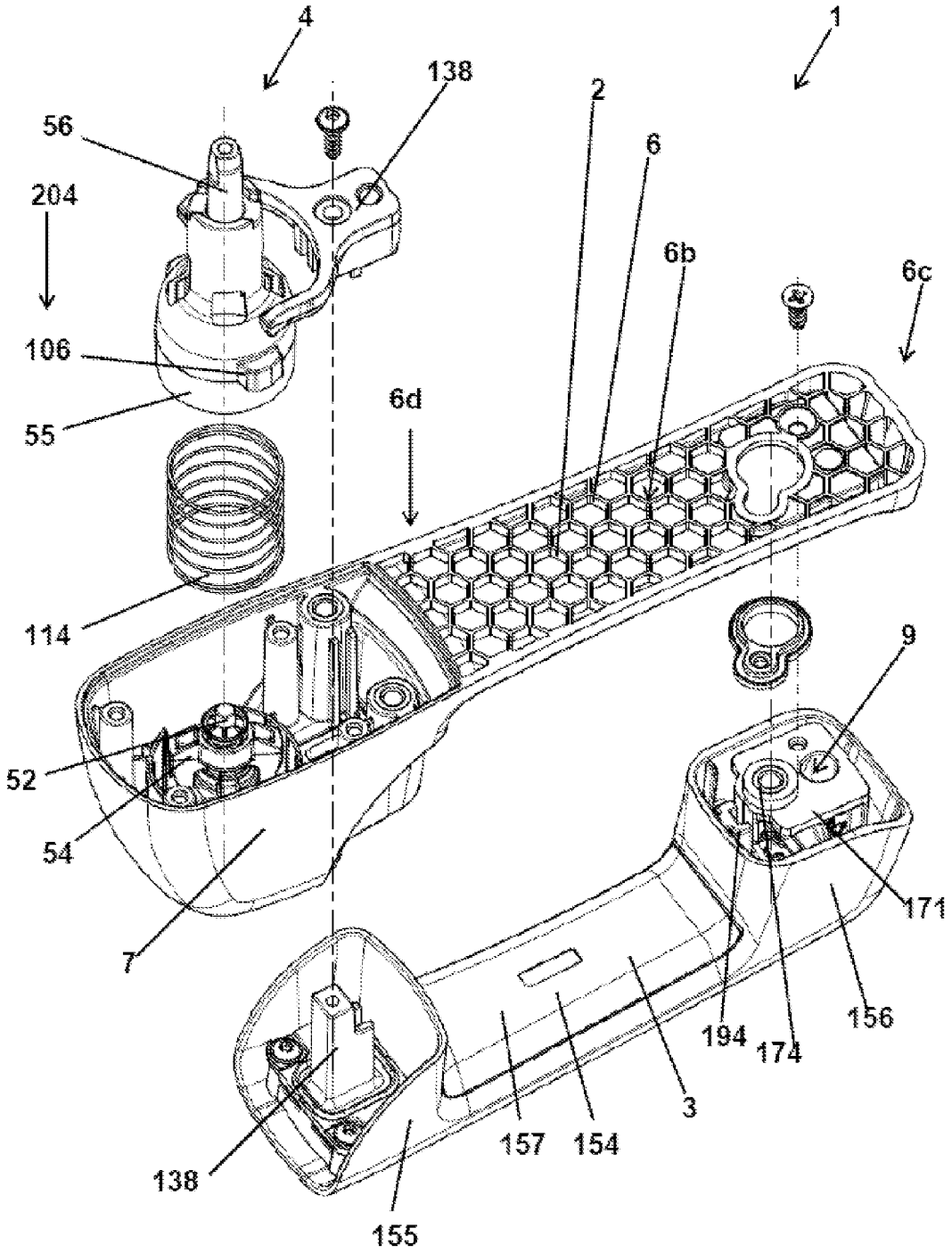
FIG. 1 is an exploded perspective view of the inventive pull handle.

The inventive pull handle 1 (FIGS. 1-3) features a pull handle housing 1*a* with a bearing part 2 and a handle part 3 connected to the bearing part 2 so as to swivel, an actuation mechanism 4 arranged in the pull handle housing 1*a* to release a lock, in particular a rotary latch lock, as well as a latching or locking mechanism 5 arranged in the pull handle housing 1*a* to lock the actuation mechanism 4, or for decoupling the actuation mechanism 4 from the handle part 3. By means of the locking mechanism 5, the actuation mechanism 4 can be opened and locked, i.e. be put out of function such that the lock cannot be unlocked when the handle part 3 is pulled. This can be achieved in that a coupling element of the actuation mechanism 4, which is used for coupling with the lock, is no longer actuated, namely the handle part 3 performs a no-load stroke, or because the handle part 3 is locked in its non-actuated position.

Figure 7:
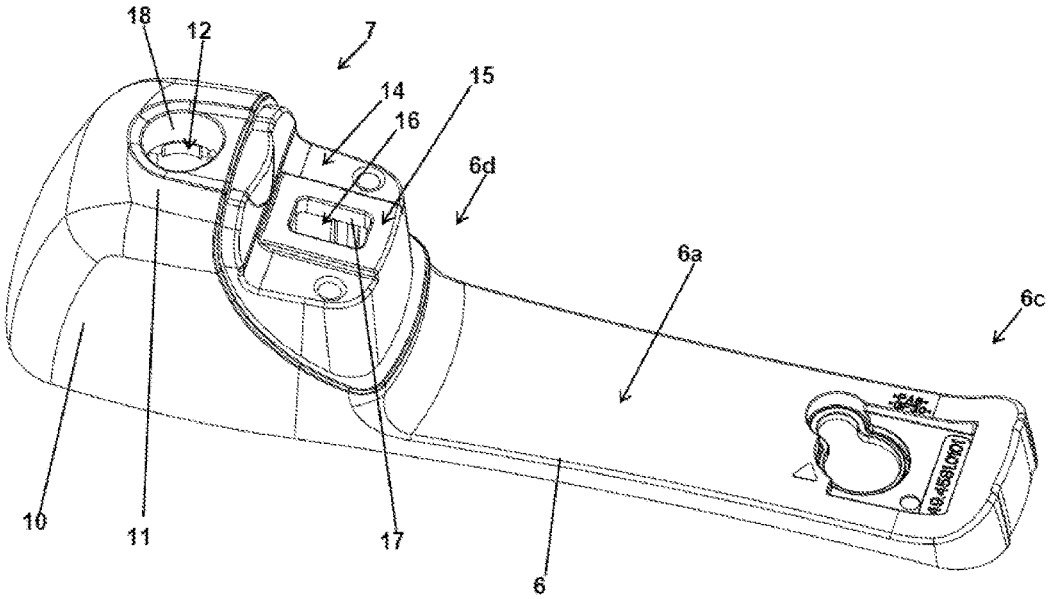
FIG. 7 is a perspective side view of the bearing part.
Figure 8:
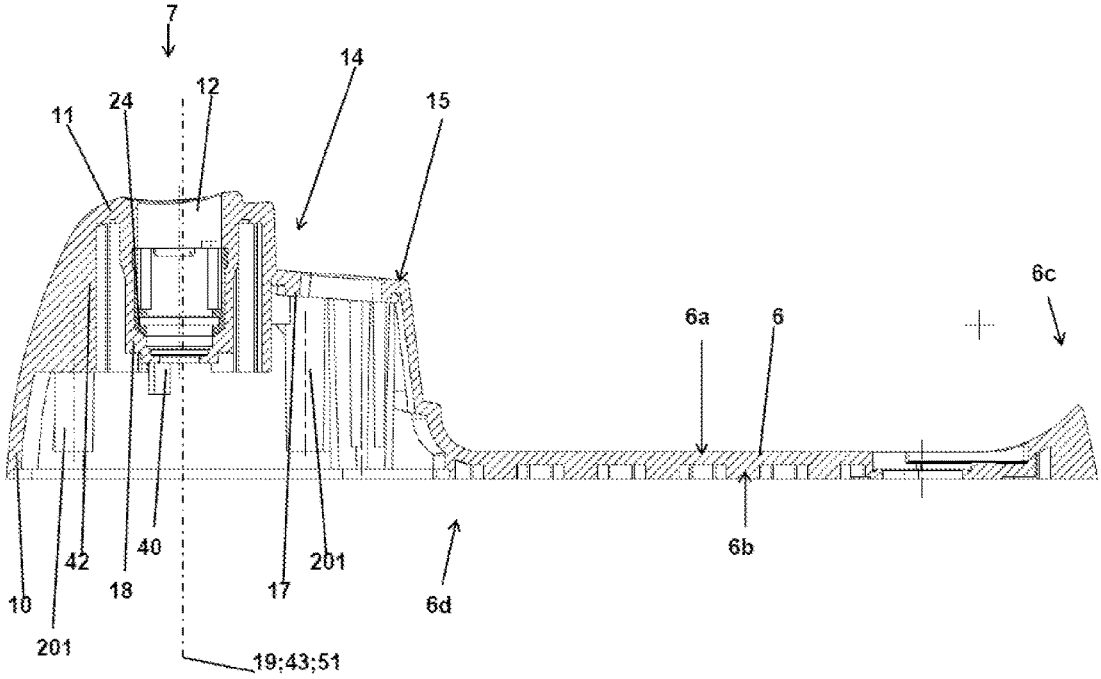
FIG. 8 is a longitudinal cross-section of the bearing part.
Figure 9:
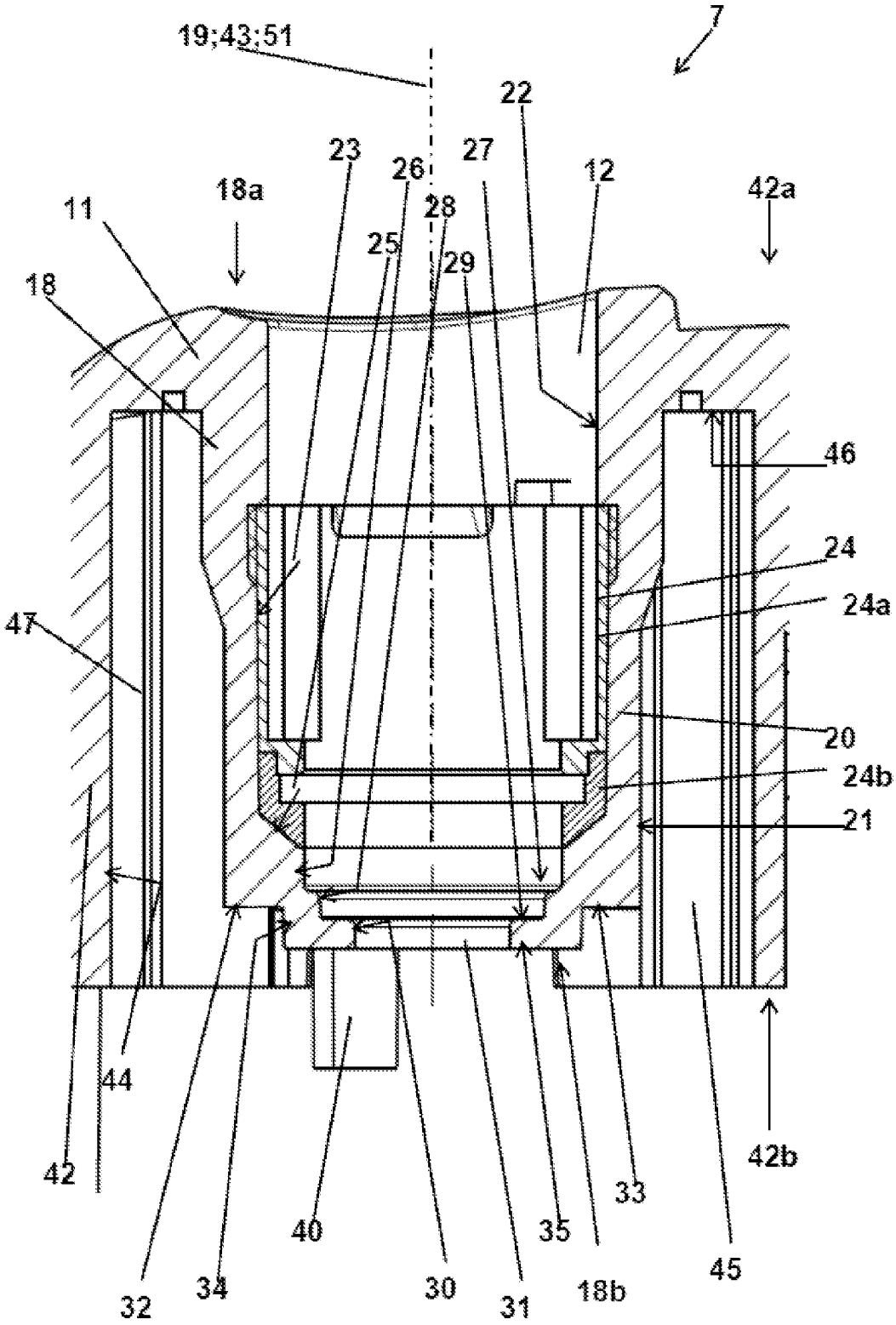
FIG. 9 is an enlarged detail of FIG. 8 in the region of the bearing housing.

The bearing part 2 (FIGS. 7, 8) features a base plate 6, a bearing housing 7 for mounting the locking mechanism 5, a cover 8, as well as a means 9 to mount the handle part 3.

The base plate 6 features a first base plate top side 6*a* facing the handle part 3, as well as a base plate top side 6*b* facing the handle part 3 and facing away from the first base plate top side 6*a*. In addition, the elongated base plate 6 has a first plate end 6*c* facing away from the bearing housing 7 and a second plate end 6*d* opposite thereto and facing the bearing housing 7.

The bearing housing 7 and the base plate 6 are preferentially configured in one piece and consist of plastic. In addition, the bearing housing 7 adjoins the bottom plate 6 at the second plate end 6*d*. Furthermore, the bearing housing 7 extends away from the first plate top side 6*a*. The bearing housing 7 is configured beaker-shaped, or cup-shaped, or dome-like, and features a surrounding circumferential wall 10 adjoining the base plate 6, as well as a housing floor 11. The bearing housing 7 is open opposite the housing bottom 11. The housing bottom 11 also features a first cylindrical housing opening 12 to receive a cylinder lock 13. In addition, the housing bottom 11 has a stepped shoulder 14 with an outer shoulder area 15. In the region of the stepped shoulder 14, the housing bottom 11 features a second, in particular rectangular, housing opening 16. An annular, rectangular stop flange 17 adjoins the second housing opening 16 on the inner side. The stop flange 17 is thus arranged inside the bearing housing 7.

The bearing housing 7 furthermore has a bearing bushing 18, which adjoins the first housing opening 12 and extends into the bearing housing 7. The bearing bushing 18 thus extends away from the housing bottom 11 to the base plate 6. The bearing bushing 18 has a bearing bushing axis 19, which extends away from the housing bottom 11 to the base plate 6. The bearing bushing axis 19 extends in particular perpendicularly to the base plate 6. The bearing bushing 18 thus features a first bushing end 18*a* on the side of the housing bottom and an opposite bushing end 18*b* facing away from the housing bottom 11. The bearing bushing 18 also has a bearing bushing wall 20 with an outer bushing wall area 21 and an inner bushing wall area 22, as well as a bushing wall base bottom area 32.

The inner bushing wall area 22 has a first cylindrical inner area section 23 viewed from the first housing opening 12 in the direction of the bearing bushing axis 19, which is used to mount a locking cylinder 24 of the cylinder lock 13. A conical inner area section 25 adjoins the first cylindrical inner area section 23, which tapers in the direction of the bearing bushing axis 19. A second inner area section 26 adjoins the conical inner area section 25, which merges via a first, flat annular section 27 into a third cylindrical inner area section 28. The third inner area section 28 features a smaller diameter than the second cylindrical inner area section 26. The third cylindrical inner area section 28 furthermore merges via a second flat annular section 29 into a fourth cylindrical inner area section 30. The fourth cylindrical inner area section 30 delimits a through opening 31.

The bushing wall bottom area 32 adjoins the outer bushing wall area 21 at a second bearing bushing end 18*b*. The bushing wall bottom area 32 features an annular latching surface 33 viewed from the outer bushing wall area 21 in the direction of the bushing bearing axis 19. The latching surface 33 thus directly adjoins the outer bottom wall area 21. A cylindrical bottom area section 34 adjoins the latching surface 33. An annular, flat contact area 35 adjoins the cylindrical bottom area section 34. The flat contact area 35 then directly adjoins the fourth cylindrical inner area section 30. In addition, the contact area 35 is perpendicular to the bearing bushing axis 19.

The latching surface 33 features two latching sections 36, which are radially opposite each other relative to the bearing bushing axis 19. The latching sections 36 respectively have two latching recesses or latching depressions 37 adjacent to each other in the circumferential direction relative to the bearing bushing axis 19. The latching recesses 37 adjacent to each other respectively merge into each other via a latching elevation 38. The latching recesses 37 and latching elevations 38 are respectively formed by wedge areas 39 tapering toward each other.

The bearing bushing 18 also features a spring pin 40 projecting from the latching surface 33, which is used to support a torsion spring 41, which will be explained in more detail below.

The bearing housing 7 also has a bearing sleeve 42, which has a bearing sleeve axis 43. The bearing sleeve axis 43 is coaxial to the bearing bushing axis 19. Furthermore, the bearing sleeve 42 is arranged around the bearing bushing 18. The bearing sleeve 42 thus surrounds the bearing bushing 18. There is thus an annular gap 45 between the bearing bushing 18, in particular the outer bearing bushing area 21, and the bearing sleeve 42, in particular between an inner bearing sleeve area 44. The annular gap 45 is delimited at the housing bottom 11 by an annular, especially flat, latching face 46. The bearing sleeve 42 likewise extends away from the housing bottom 11. As a result, the bearing sleeve 42 features a first bearing sleeve end 42*a* on the side of the housing bottom and a second bearing sleeve end 42*b* opposite thereto facing away from the housing bottom 11.

The bearing sleeve 42 also features several guide ribs 47 spaced apart from each other and arranged adjacent to each other in the circumferential direction relative to the bearing sleeve axis 43. The guide ribs 47 adjoin the cylindrical inner bearing sleeve area 44 and project radially inward therefrom. Furthermore, the guide ribs 47 extend from the first to the second bearing sleeve end 42*a*, 42*b*, namely over the entire length of the bearing sleeve 42.

Figure 2:
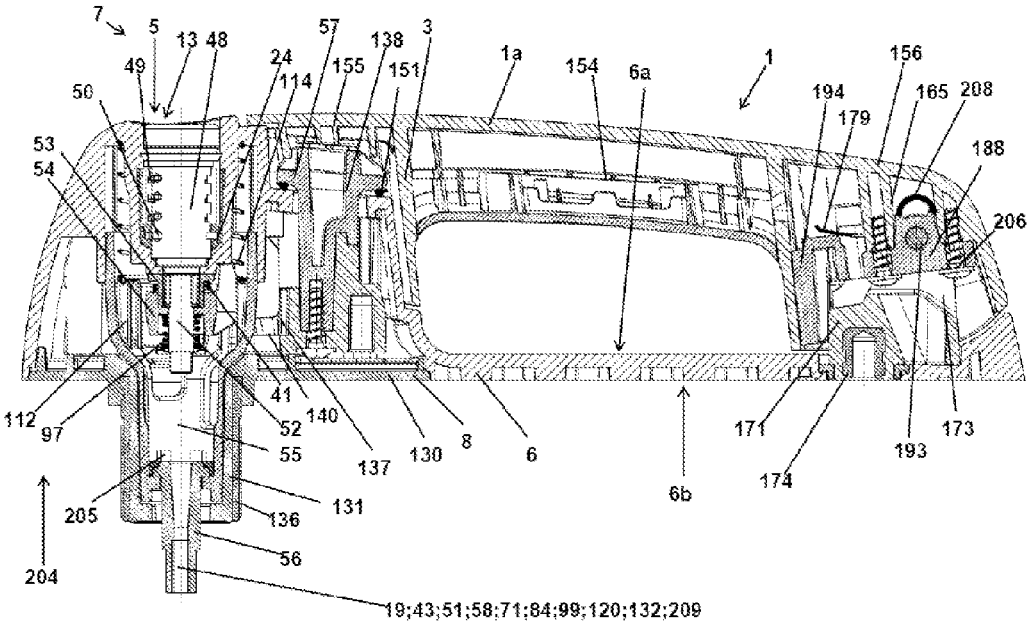
FIG. 2 is a longitudinal cross-sectional view of the pull handle in the non-actuated position.
Figure 3:
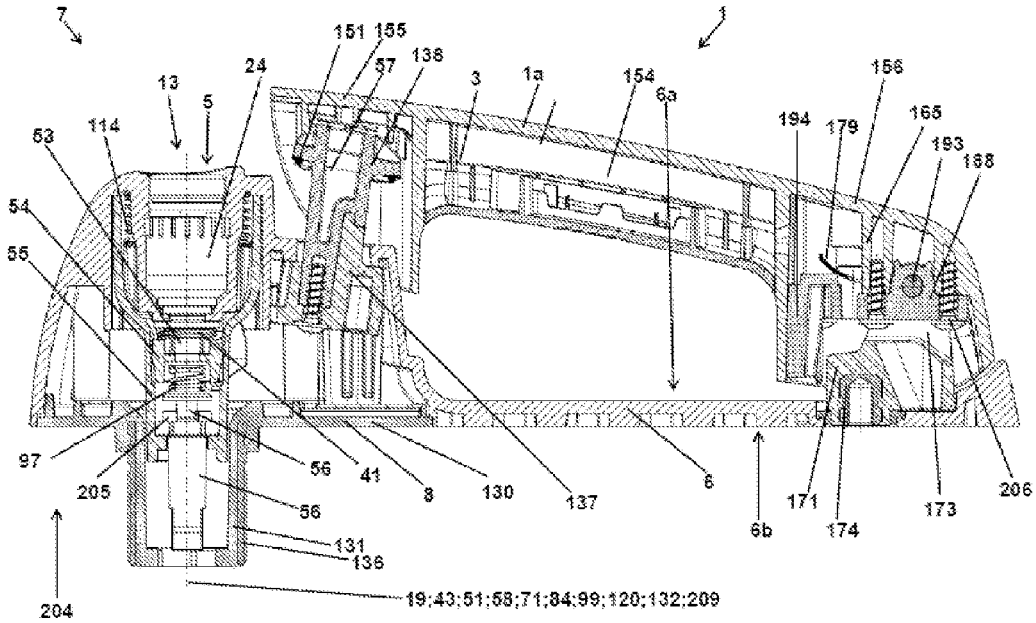
FIG. 3 is a longitudinal cross-sectional view of the pull handle in the actuated position.

As already explained above, the inventive pull handle 1 features a locking mechanism 5 with a cylinder lock 13 (FIGS. 2, 3). The cylinder lock 13 features the locking cylinder 24, as well as a cylinder core 48 with the spring-loaded, disk tumblers 49 arranged therein and a locking tumbler 50 in a manner known per se. The locking cylinder 24 features a cylinder axis 51, is preferentially configured in two pieces, and has a first and a second cylinder part 24*a*, 24*b*. The cylinder axis 51 is coaxial to the bearing sleeve axis 19. The two cylinder parts 24*a*, 24*b* are pressed together. Furthermore, an annular slot is formed between the two cylinder parts 24*a*, 24*b* into which the locking tumbler 50 engages. As a result, the cylinder core 48 is mounted in the locking cylinder 24 so that it cannot be axially displaced. The locking cylinder 24 is also molded into the bearing housing 7, namely mounted therein, so that it cannot be displaced or rotated. The locking cylinder 24 is thereby arranged inside the bearing bushing 18 and rests on the first cylindrical inner area section 23 and on the conical inner area section 25.

The cylinder core 48 is arranged inside the locking cylinder 24 in a manner known per se. If a matching key is not inserted into the cylinder core 48, the disk tumblers 49 are pressed into grooves of the locking cylinder 24 by means of springs, so that the cylinder core 48 cannot be rotated around the cylinder axis 51. If a matching key is inserted, the disk tumblers 49 are drawn into the cylinder core 48, so that the cylinder core 48 can be rotated around the cylinder axis 51 in the locking cylinder 24, which is known per se.

The locking mechanism 5 also features an adapter pin 52, an actuator sleeve 53, and a latching sleeve 54.

Figure 11:
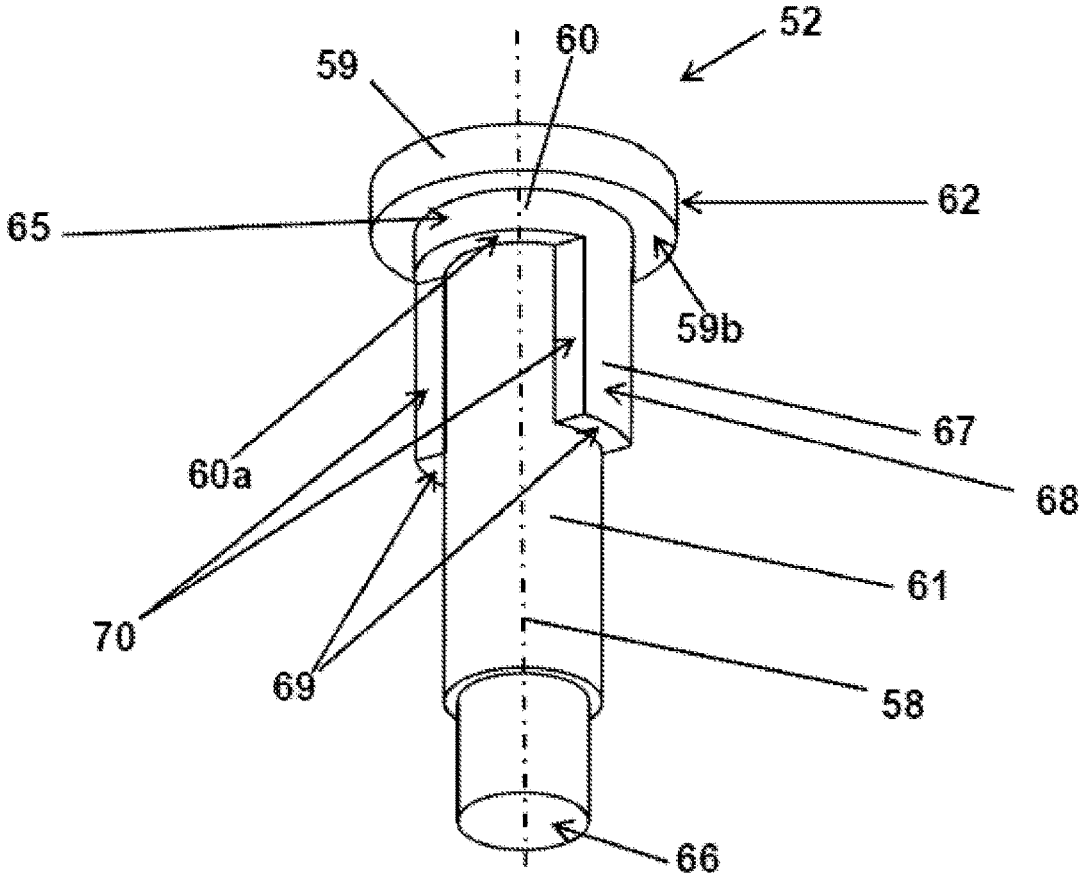
FIG. 11 is a first perspective view of an adapter pin.
Figure 12:
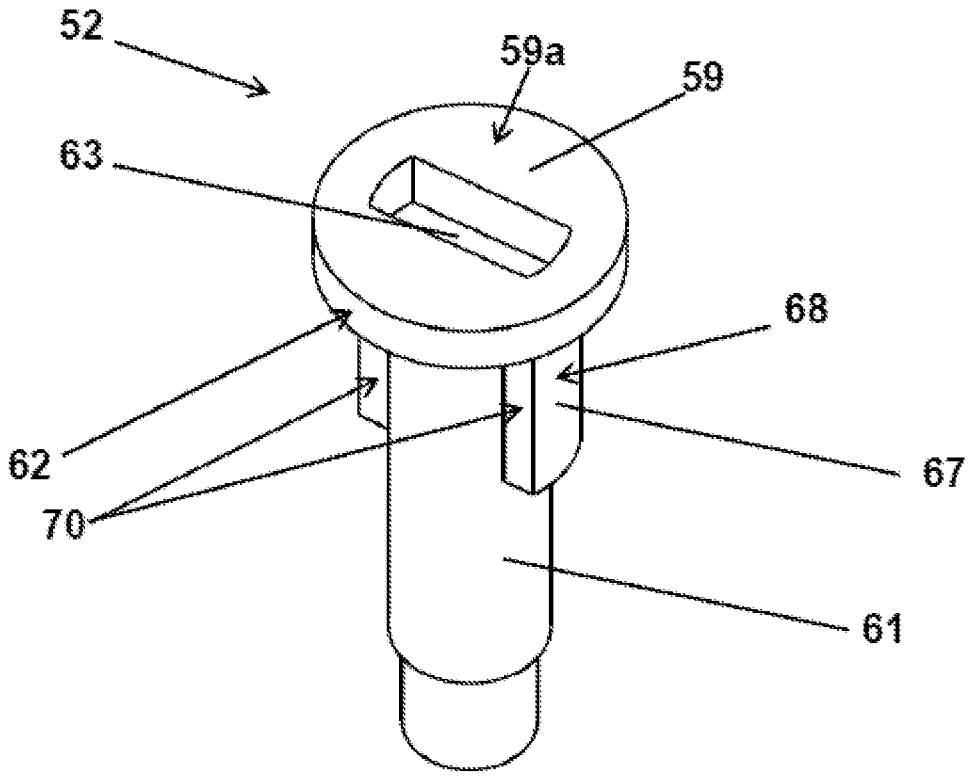
FIG. 12 is another perspective view of the adapter pin.

There is an adapter pin 52 (FIGS. 11, 12) available to transfer or transmit the rotary movement of the cylinder core 48. The adapter pin 52 preferentially consists of metal, especially of zinc, and was, in particular, produced by die casting. The adapter pin 52 longitudinally extends in the direction of a longitudinal adapter pin axis 58, which is coaxial to the cylinder axis 51. Furthermore, the adapter pin 52 has an adapter pin head 59, an adapter pin collar 60 adjoining the adapter pin head 59, and an adapter pin shaft 61 adjoining the adapter pin collar 60. Thus, the adapter pin 52 features a head end or an adapter pin drive end 52*a* and a foot end 52*b* opposite the head end 52*a* viewed in the direction of the longitudinal adapter pin axis 58. The adapter pin head 59 has a head top side 59*a* which is advantageously configured level. In addition, the adapter pin head 59 features a circumferential, cylinder barrel-shaped head edge surface 62 and an advantageously level head bottom side 59*b* opposite the head top side 59*a*. The head top side 59*a* and the head bottom side 59*b* are preferentially perpendicular to the longitudinal adapter pin axis 58. In addition, the adapter pin head 59 features a drive slot 63, which protrudes from the head top side 59*a* into the adapter pin head 59. The drive slot 63 is used for coupling with the cylinder core 48, and features a drive pin 64 on its end facing the adapter pin 52, which positively engages into the drive slot 63.

The adapter pin collar 60 adjoins the head bottom side 59*b* of the adapter pin head 59 and features a circumferential, cylinder barrel-shaped collar edge area 65 and an advantageously level collar bottom side 60*a* opposite the head bottom side 59*b*. The collar bottom side 60*a* is preferentially perpendicular to the cylinder axis 51 and the adapter pin axis 58. The diameter of the collar edge area 65 is smaller than the diameter of the head edge area 62.

The adapter pin shaft 61 is configured cylindrically and forms the foot end 52*b* on its end facing away from the adapter pin collar 60. Furthermore, the adapter pin shaft 61 features a cylindrical outer shaft area 61*a* which preferentially slightly tapers via a shoulder at the foot end 52*b* opposite the head end 52*a*. The diameter of the outer shaft area 61*a* is smaller than the diameter of the collar edge area 65. At the foot end 52*b*, the adapter pin shaft 61 features an advantageously level end area 66 perpendicular to the longitudinal adapter pin axis 58.

The adapter pin 52 also has two driving ribs 67 radially opposing each other relative to the longitudinal adapter pin axis 58. The driving ribs 67 directly adjoin the collar bottom side 60*a* and extend radially as well as along the longitudinal adapter pin axis 58. They are thus cylindrical tube sections. The driving ribs 67 radially project from the adapter pin shaft 61. The driving ribs 67 feature a cylindrical outer rib area 68 whose diameter preferentially corresponds to the diameter of the collar edge area 65. The driving ribs 67 preferentially do not extend along the entire length of the adapter pin shaft 61. As a result, they respectively have a rib end area 69 on their end facing away from the adapter pin collar 60. The rib end area 69 is respectively preferentially configured level and perpendicular to the longitudinal adapter pin axis 58. Furthermore, the driving ribs 67 respectively feature two preferentially level rib edges 70 radially delimiting the driving ribs 67. The rib edges 70 extend parallel to the longitudinal adapter pin axis 58.

Figure 13:
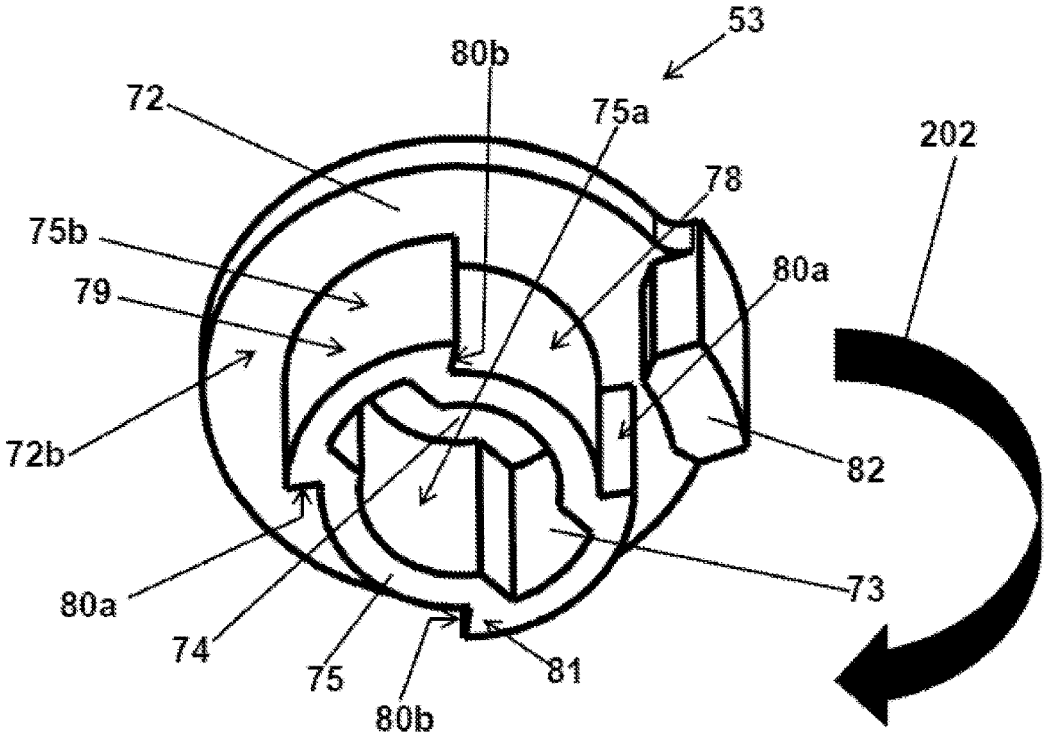
FIG. 13 is a perspective view of the actuator sleeve.
Figure 14:
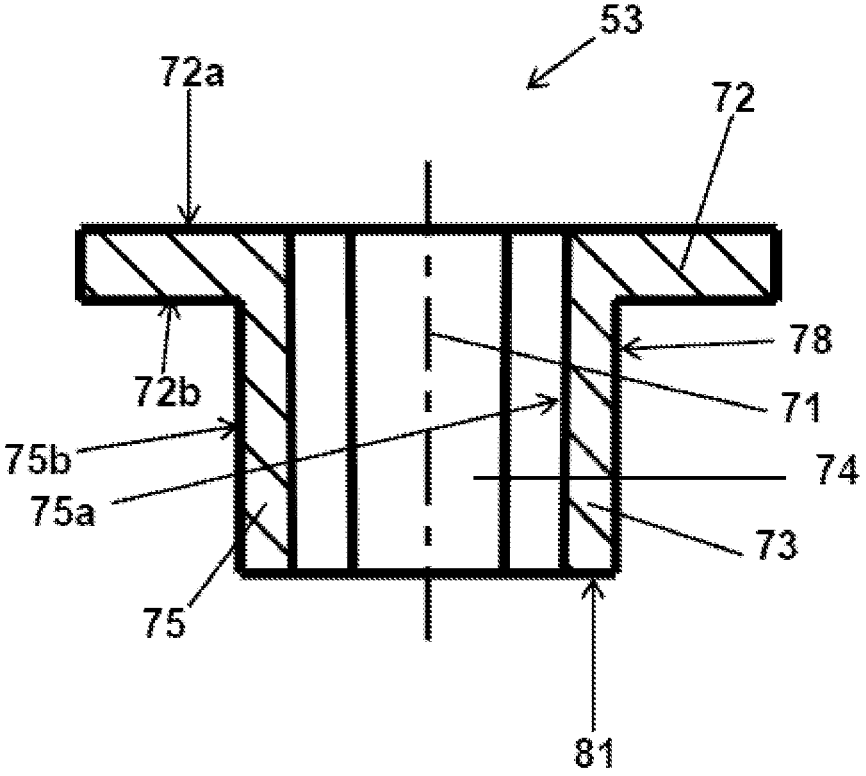
FIG. 14 is a longitudinal cross-section of the actuator sleeve.

The actuator sleeve or driving bushing 53 (FIGS. 13, 14) is used to transmit the rotatory movement of the adapter pin 52 to the latching sleeve 54. It preferentially consists of metal, in particular zinc, and was, in particular, produced by die casting. The actuator sleeve 53 longitudinally extends in the direction of the actuator sleeve axis 71, which is coaxial to the longitudinal adapter pin axis 58. In addition, the actuator sleeve 53 features a head disk and a tubular, or sleeve-shaped, sleeve shaft 73 adjoining the head disk 72. The head disk 72 has a disk top side 72*a* and a disk bottom side 72*b* opposite thereto. The disk top side 72*a* and the disk bottom side 72*b* are level and perpendicular to the longitudinal actuator sleeve axis 71. The sleeve shaft 73 adjoins the disk bottom side 72*b* and extends away therefrom. In addition, the actuator sleeve 53 features a sleeve recess 74 penetrating through the actuator sleeve 53 in the direction of the longitudinal actuator sleeve axis 71. The cross-sectional shape of the sleeve recess 74 corresponds to the cross-sectional shape of the adapter pin shaft 61 in the region of the driving ribs 67.

Figure 4:
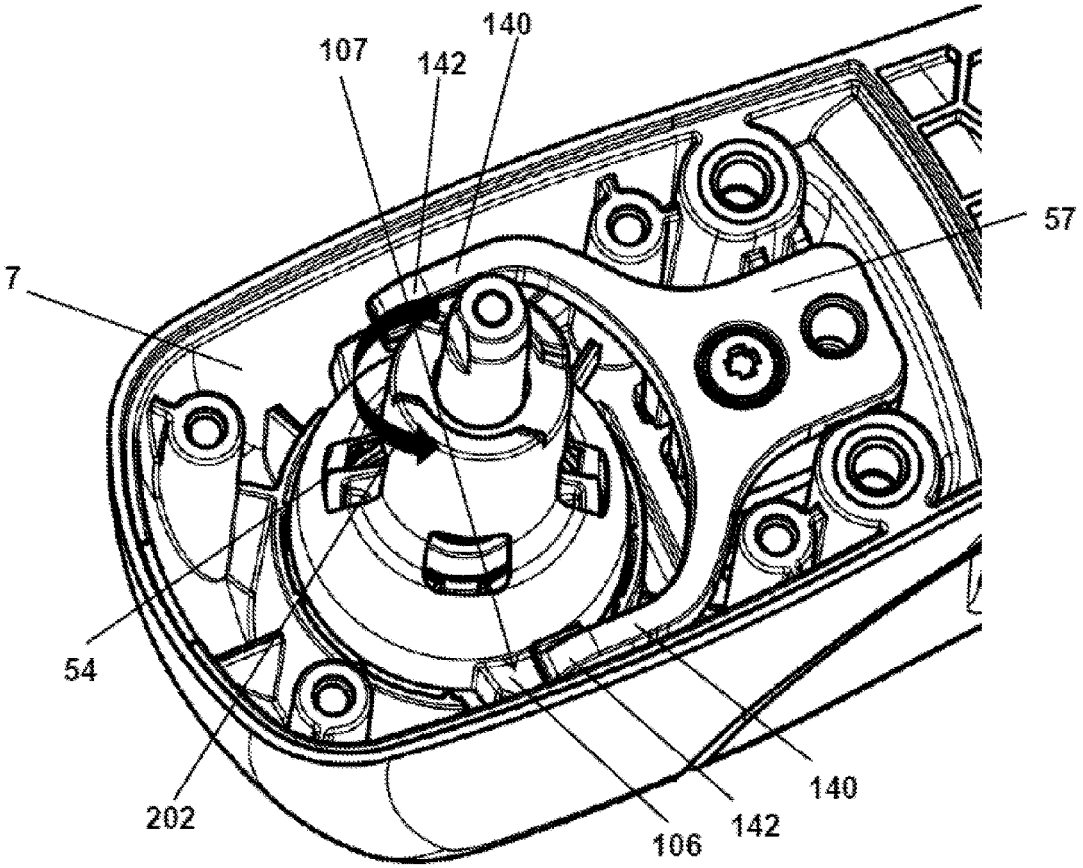
FIG. 4 is a top view of a part of the actuation mechanism in the coupled or unlocked and actuated position.

The sleeve shaft 73 features a tubular shaft wall 75 with an outer shaft wall area 75*b* and an inner shaft wall area 75*a*. Since the inner shaft wall area 75*a* delimits the sleeve recess 74, the course of the inner shaft wall area 75*a* likewise corresponds to the cross-sectional shape of the adapter pin 61 in the region of the driving ribs 67. The outer shaft wall area 75*b* has two first guide areas 78, which are radially opposite each other relative to the longitudinal actuator sleeve axis 71. The first guide areas 78 are configured as cylindrical segment areas. They are also configured rotationally symmetrical to the longitudinal actuator sleeve axis 71 and form segments of an outer jacket area of a circular cylinder. In addition, the outer shaft wall area 75*b* has two second guide areas 79, likewise radially opposite each other relative to the actuator longitudinal sleeve axis 71. The second guide areas 79 are likewise configured as cylindrical segment areas. They are thus likewise configured rotationally symmetrical to the longitudinal actuator sleeve axis 71. The diameter of the second guide areas 79, however, is greater than the diameter of the first guide areas 78. As a result, the second guide areas 79 are offset radially outward relative to the first guide areas 78. In this way, the first guide areas 78 are arranged between the second guide areas 79 viewed in the circumferential direction. There is an actuation area 80*a; b* available between the first and second guide areas 78, 79 via which the guide areas 78, 79 merge into each other. Overall, there are thus four actuation areas 80*a: b*, namely two first actuation areas 80*a* and two second actuation areas 80*b*. The first actuation areas 80*a* are used for locking, and the second actuation areas 80*b* are used for unlocking, which will be explained in more detail below. The first actuation areas 80*a* extend in the locking direction 202 (FIGS. 4, 13), when viewed from one of the first guide areas 78, to the second guide area 79 adjacent thereto that is offset outward. The second actuation areas 80*b* extend in the locking direction 202, when viewed from one of the second guide areas 79, to the first guide area 78 adjacent thereto that is offset inward. Viewed in the locking direction 202 is understood to mean that the outer shaft wall area 75*b* is pulled out in the locking direction 202. The preferentially level actuation areas 80*a*; b also extend in the radial direction and parallel to the longitudinal actuator sleeve axis 71.

The sleeve shaft 73 of the actuator sleeve 53 also has a preferentially level shaft end area 81 opposite to the head disk 72. The shaft end area 81 is preferentially perpendicular to the longitudinal actuator sleeve axis 71. In addition, the actuator sleeve 53 features a spring pin 82 which projects from the disk bottom side 72*b* and is spaced apart from the outer shaft wall area 75*b*.

Figure 15:
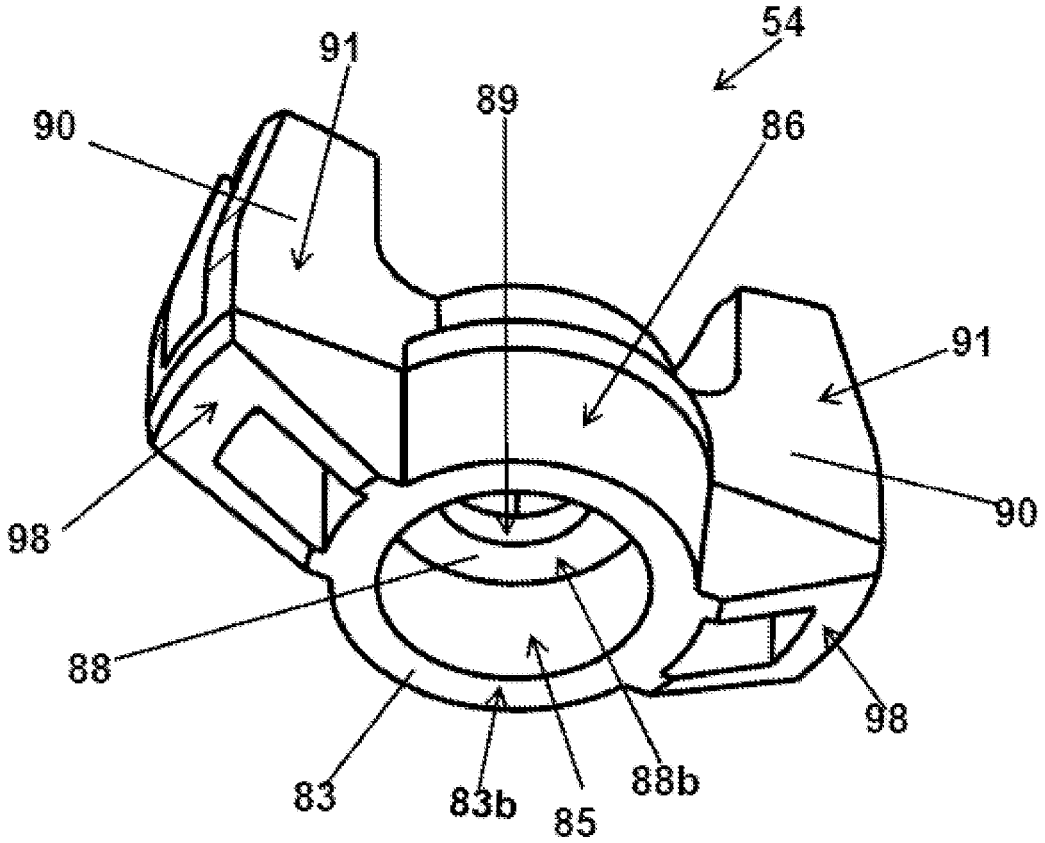
FIG. 15 is a first perspective view of a latching sleeve.
Figure 16:
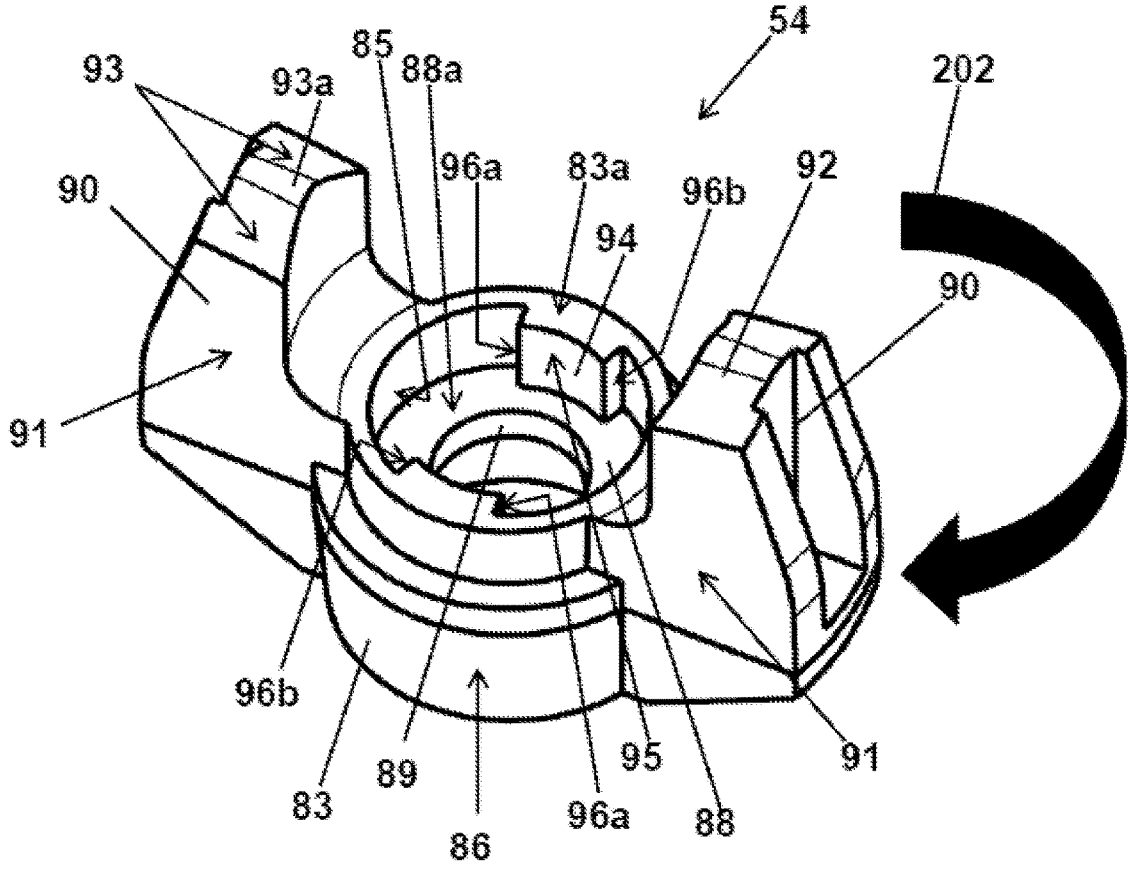
FIG. 16 is another perspective view of the latching sleeve.
Figure 17:
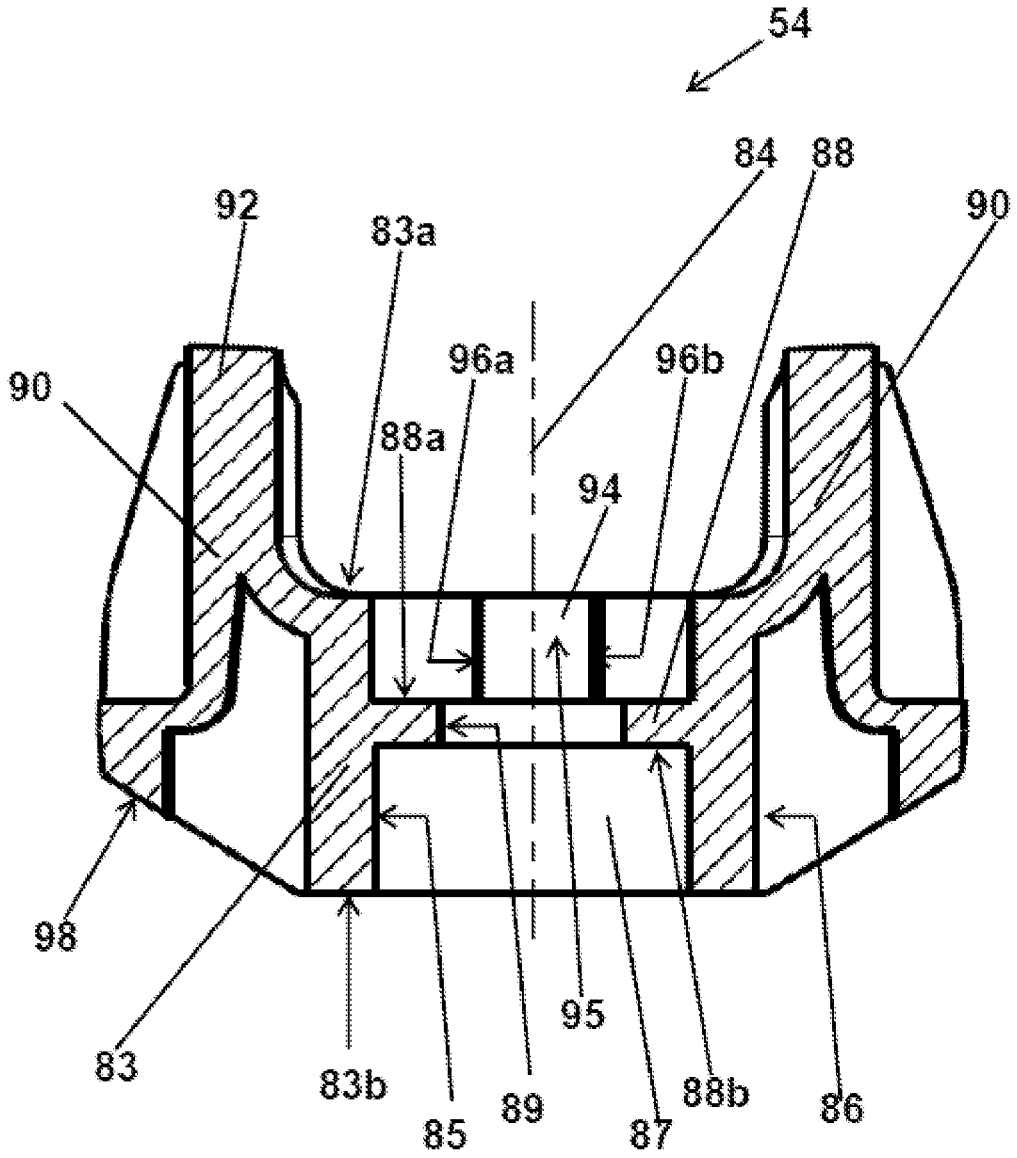
FIG. 17 is a longitudinal cross-section of the latching sleeve.
Figure 18:
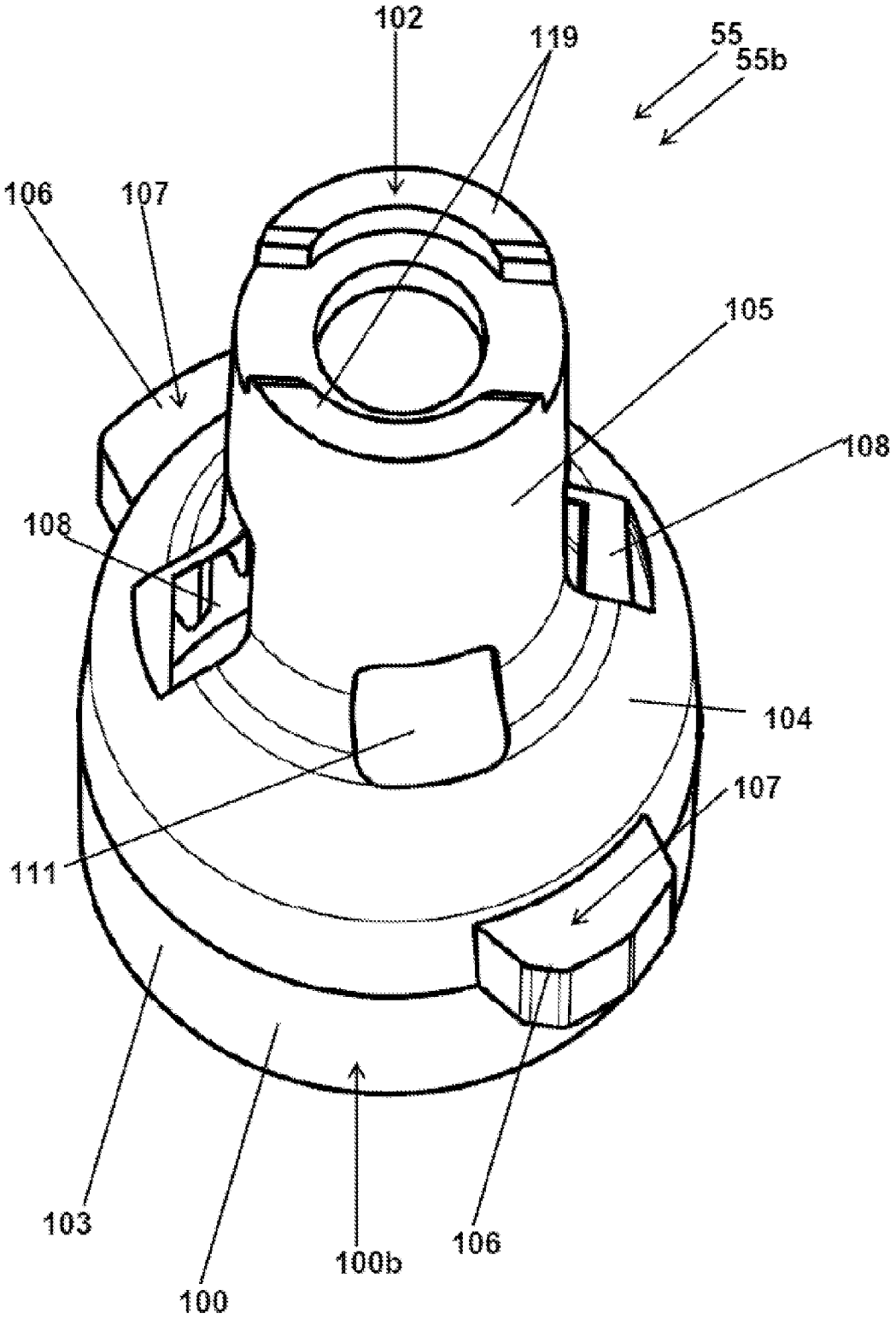
FIG. 18 is a first perspective view of a coupling sleeve.
Figure 19:
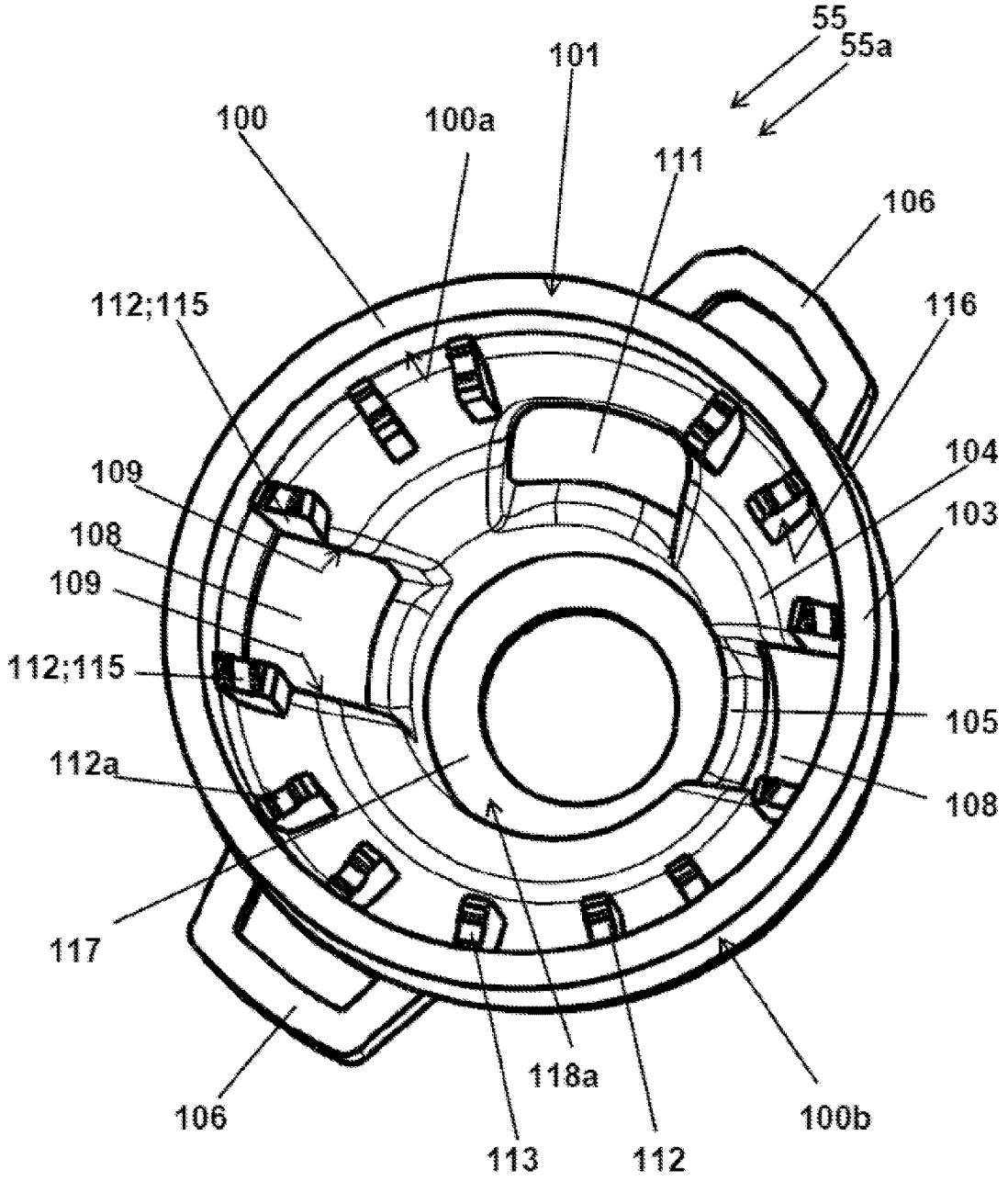
FIG. 19 is another perspective view of the coupling sleeve.
Figure 20:
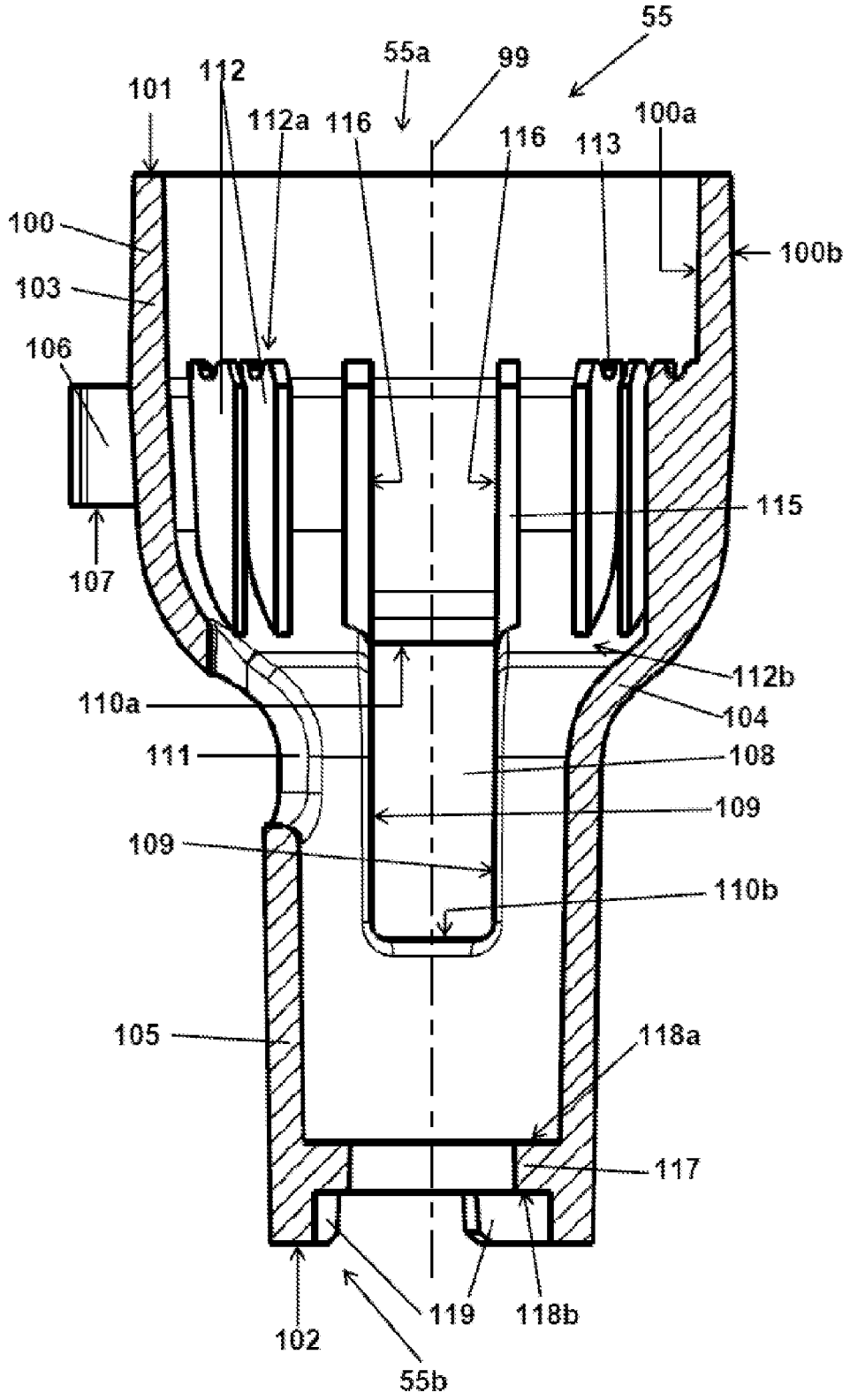
FIG. 20 is a longitudinal cross-section of the coupling sleeve.

The latching sleeve 54 (FIGS. 15-17) is used to transfer the rotary movement of the actuator sleeve 53 to a coupling sleeve 55 of the actuation mechanism 4. The latching sleeve 54 features a latching sleeve wall 83 as well as a latching sleeve axis 84, which is coaxial to the cylinder axis 51. The tubular latching sleeve wall 83 features a circular inner cylindrical wall area 85 and a circular outer cylindrical wall area 86. The inner wall area 85 delimits a recess 87 passing through the latching sleeve 54 in the direction of the latching sleeve axis 84. The diameter of the inner wall area 85 corresponds to the diameter of the second guide areas 79 of the actuator sleeve 53. Furthermore, the sleeve wall 83 features a first, annular, and preferentially level, wall end area 83*a*, and a second, annular, and preferentially level, wall end area 83*b*. In addition, the latching sleeve 54 has an annular collar 88. The annular collar 88 adjoins the inner wall area 85 and extends radially inward therefrom to the latching sleeve axis 84. The annular collar 88 features a first annular collar surface 88*a* facing the first wall end area 83*a* and a second annular surface 88*b* facing the second wall end area 83*b*. The annular collar 88 also has a circular cylindrical inner annular area 89. The annular collar 88 is preferentially, essentially centered between the first and the second wall end area 83*a*, 83*b*.

The latching sleeve 54 also has two latching arms 90, which are formed on the outer wall area 86 and project therefrom. The latching arms 90 extend longitudinally parallel to the latching sleeve axis 84. The two latching arms 90 are arranged radially opposite each other relative to the latching sleeve axis 84. Furthermore, the latching arms 90 adjoin the outer wall areas 86 in the area of the second wall end area 83*b* and extend to the first wall end area 83*a* and beyond it. In addition, the two latching arms 90 have two slide surfaces 91 respectively parallel to each other. The slide surfaces 91 are respectively configured level and extend parallel to the latching sleeve axis 84. All four slide surfaces 91 are preferentially parallel to each other. The slide surfaces 91 are respectively preferentially perpendicular to the wall end areas 83*a*, 83*b*. On their free ends, the latching arms 90 feature a detent 92. This detent 92 has two wedge areas 93, which taper toward each other and merge into each other via a detent edge 93*a*. The latching arms 90 respectively feature a latching surface 98 on their end opposite the detent 92.

The latching sleeve 54 also has two driving ribs 94 that are radially opposite each other. The driving ribs 94 directly adjoin the inner wall area 85 and also extend radially and in the longitudinal direction of the latching sleeve axis 84. They are thus circular cylindrical tube segments. The driving ribs 94 protrude radially inward from the wall inner area 85. The driving ribs 94 also adjoin the first annular collar surface 88*a* and extend to the first wall end area 83*a* and are flush therewith. The driving ribs 94 feature a circular cylindrical inner rib area 95 whose diameter corresponds to the diameter of the first guide areas 78. Furthermore, the driving ribs 94 respectively feature two preferentially level first and second rib edges 96*a*; b radially delimiting the driving ribs 94. The rib edges 96*a*; b extend parallel to the latching sleeve axis 84 and radially relative to the latching sleeve axis 84. Overall, there are thus four rib edges 96*a*; b available, namely two first rib edges 96*a* and two second rib edges 96*b*. The first rib edges 96*a* are used for locking and the second rib edges 96*b* are used for unlocking, which will be explained in more detail below. The first rib edge 96*a* is the first rib edge 96*a* of the driving rib 94 viewed in the locking direction 202; the second rib edge 96*b* of the driving rib 94 is downstream from the first rib edge 96*a* of the driving rib 94 in the locking direction 202.

In the assembled state, the bearing shaft 73 of the actuator sleeve 53 is arranged in the recess 87 such that the shaft end area 81 rests on the first annular collar surface 88*a*. In addition, the two guide areas 79 of the actuator sleeve 53 rest on the inner wall area 85 of the latching sleeve 54. And the first guide areas 78 of the actuator sleeve 53 rest on the inner rib areas 95 of the driving ribs 94. And the actuation areas 80*a: b* of the actuator sleeve 53 are arranged between the rib edges 96*a; b* of the driving ribs relative to the latching sleeve axis 84, when viewed in the circumferential direction.

The distance of the rib edges 96*a*; b, viewed in the circumferential direction, from the driving ribs 94 adjacent to each other in the circumferential direction is larger than the extension of the second guide areas 79 in the circumferential direction. And the distance of the rib edges 96*a*; b of a driving rib 94, viewed in the circumferential direction, is smaller than the extension of the first guide area 78 in the circumferential direction. As a result, there is a play, or free-wheel, with respect to the rotary movement around the cylinder axis 51 between the actuator sleeve 53 and the latching sleeve 54. That is to say, the latching sleeve 54 and the actuator sleeve 53 can be rotated with respect to each other by a limited amount around the cylinder axis 51, which will be explained in more detail below. In particular, the free-wheel, namely the amount by which the actuator sleeve 53 and the latching sleeve 54 can be rotated relative to each other, is 40 to 50°, preferably 45°.

In the installed state, the detents 92 are arranged in locking depressions 37, which will be explained in more detail below.

As already explained above, the inventive pull handle 1 also features an actuation mechanism 4 to actuate a lock. The actuation mechanism 4 features the coupling sleeve 55, a coupling pin 56, as well as a driving fork 57.

The coupling sleeve 55 (Figures longitudinal 18-20) preferentially consists of plastic and longitudinally extends in the direction of the coupling sleeve axis 99 which is coaxial to the cylinder axis 51. Furthermore, the coupling sleeve 55 features a first coupling sleeve end 55*a* and a second coupling sleeve end 55*b* opposite thereto. The tubular coupling sleeve 55 also has a coupling sleeve wall 100 with an inner wall area 100*a* and an outer wall area 100*b*. At the first coupling sleeve end 55*a*, the coupling sleeve wall 100 features a first, preferentially level, annular end area 101 which preferentially is perpendicular to the longitudinal coupling sleeve axis 99. At the second coupling sleeve end 55*b*, the coupling sleeve wall 100 features a second, preferentially level, annular end area 102, which likewise preferentially is perpendicular to the longitudinal coupling sleeve axis 99. In addition, the coupling sleeve wall 100 first features a circular cylindrical bearing section 103, viewed from a first coupling sleeve end 55*a*, in the direction of the longitudinal coupling sleeve axis 99. A transition section 104 adjoins the circular cylindrical bearing section 103. The coupling sleeve wall 100 tapers toward the longitudinal coupling sleeve axis 99 in the region of the transition section 104. That is to say, the outer diameter and the inner diameter of the coupling sleeve wall 100 decrease. A circular cylindrical guide section 105 adjoins the transition section 104.

The coupling sleeve 55 also features two coupling pins 106 preferentially radially opposite each other relative to the longitudinal coupling sleeve axis 99. The coupling pins 106 adjoin the outer wall area 100*b* of the coupling sleeve wall 100, and project radially therefrom. The coupling pins 106 feature a coupling area 107 facing the second coupling sleeve end 55*b*, which preferentially is level and perpendicular to the longitudinal coupling sleeve axis 99. In addition, the coupling pins 106 are arranged in the region of the bearing section 103 spaced apart from the first coupling sleeve end 55*a*.

Furthermore, the coupling sleeve 55 features two guide slots 108 radially opposite each other relative to the longitudinal coupling sleeve axis 99. The guide slots 108 begin in the transition area 104 and extend into the guide section 105. The guide slots 108 are used for transferring the rotary movement from the latching sleeve 54 to the coupling sleeve 55. The coupling sleeve 55 is also guided. The guide slots 108 feature two lateral guide edges 109 that are preferentially level, opposite and parallel to each other, as well as two slot end edges 110*a*; b. The first slot end edge 110*a* faces the first coupling sleeve end 55*a*, and the second slot edge 110*b* faces the second coupling sleeve end 55*b*. In this way, the second slot end edge 110*b* is spaced apart from the second coupling sleeve end 55*b*.

The coupling sleeve 55 also features a window 111 passing through the coupling sleeve wall 100. The window 111 is arranged between both guide slots 108 viewed in the circumferential direction of the coupling sleeve 55. In addition, the window 111 likewise begins in the transition section 104 and extends into the guide section 105. The window 111, however, does not extend as far into the guide area 105 as the guide slot 108. The window 111 is used to receive the two spring pins 40, 82.

In addition, the coupling sleeve 55 features several ribs 112 distributed in the circumferential direction of the coupling sleeve 55. The ribs 112 adjoin the inner wall area 100*a* of the coupling sleeve wall 100 and radially project therefrom. The ribs 112 begin in the bearing section 103 and extend into the transition section 104. Furthermore, the ribs 112 have a first rib end 112*a* facing the first coupling sleeve end 55*a* and a second rib end 112*b* facing the second coupling sleeve end 55*b*. At the first rib end 112*a*, the ribs 112 feature a receiving trough 113 to receive a first pressure spring 1. The first rib end 112*a* is spaced apart from the first coupling sleeve end 55*a*. The second rib end 112*b* is situated at the height of the first slot edge 110*a*. In addition, two ribs 112 are arranged aligned with the guide edges 109 of the guide slots 108 viewed in the direction of the longitudinal coupling sleeve axis 99. These ribs 112 form the guide ribs 115, which are used to guide the coupling sleeve 55 through the latching sleeve 54. The two guide ribs 115 feature a level guide area 116. The guide areas 116 of the guide ribs 15 corresponding to each other are facing each other and parallel to each other.

On its second coupling sleeve end 55*b*, the coupling sleeve 55 also has an annular bearing shoulder 117 protruding into the inside of the coupling sleeve 55. The bearing shoulder 117 adjoins the inner wall area 100*a* of the coupling sleeve wall 100 and projects radially inward therefrom. The bearing shoulder 117 has a first level shoulder area 118*a* perpendicular to the longitudinal coupling sleeve axis 99, as well as a second level shoulder area 118*b* perpendicular to the longitudinal coupling sleeve axis 99. The first bearing shoulder area 118*a* faces the first coupling sleeve end 55*a*, and the second bearing shoulder 118*b* faces the second coupling sleeve end 55*b*. Two cylindrical tube segments 119, which are radially opposite each other and are spaced apart from each other in the circumferential direction, adjoin the second bearing shoulder 118*b*. The cylindrical tube segments 119 form the second end area 102.

Figure 21:
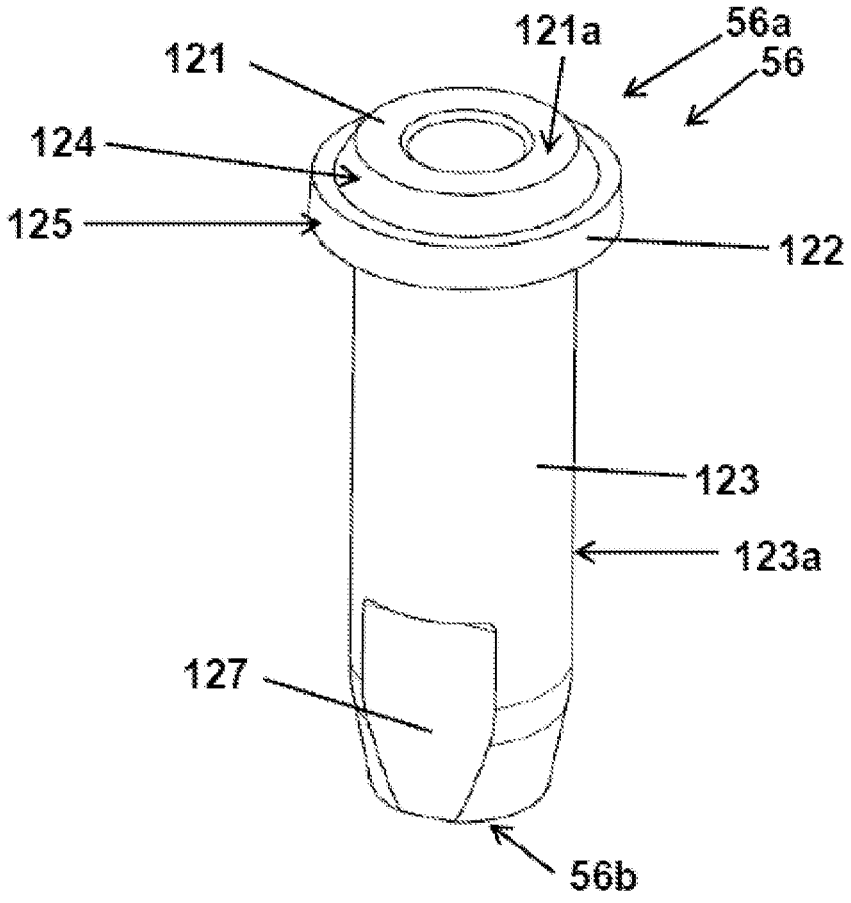
FIG. 21 is a perspective view of a coupling pin.
Figure 22:
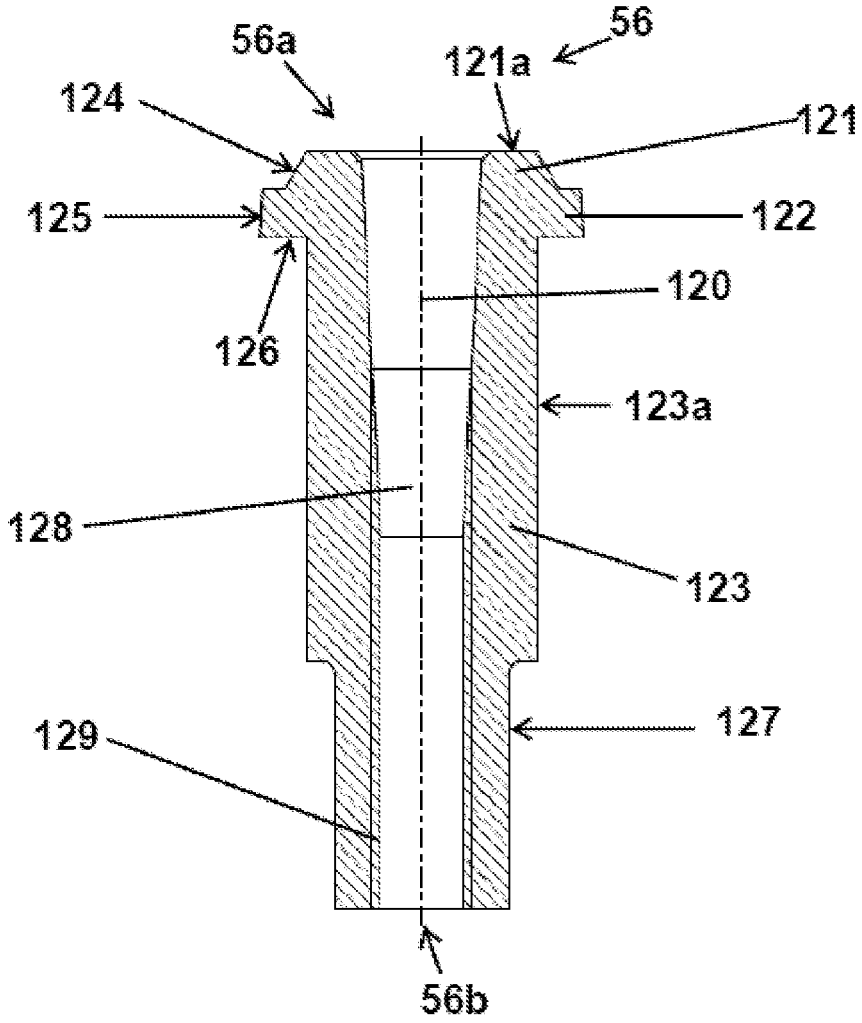
FIG. 22 is a longitudinal cut through the coupling pin.

In order to transfer the axial movement of the coupling sleeve 55 in the direction of the cylinder axis 51, or of the longitudinal coupling sleeve axis 99 to the lock mechanism, there is a coupling pin 56 (FIGS. 21, 22) available. The coupling pin 56 preferentially consists of metal, in particular zinc, and was produced, in particular, by die casting. The coupling pin 56 longitudinally extends in the direction of a longitudinal coupling pin axis 120, which is coaxial to the cylinder axis 51 and to the longitudinal coupling sleeve axis 99. In addition, the coupling pin 56 features a coupling pin head 121, a coupling pin collar 122 adjoining the coupling pin head 121, and a coupling pin shaft 123 adjoining the coupling pin collar 122. Thus, the coupling pin 56 features a head end or a coupling pin drive end 56*a*, viewed in the direction of the longitudinal coupling pin axis 120, and a foot end 56*b* opposite the head end 56*a*. The coupling pin head 121 has a head surface 121*a* which is advantageously configured level and perpendicular to the longitudinal coupling pin axis 120. The coupling pin head 121 also has a circumferential conical head edge area 124.

The annular coupling pin collar 122 adjoins the head edge surface 124 of the coupling pin head 121 and features a circumferential, circular cylindrical jacket-shaped collar edge area 125 and an advantageously level collar bottom side 126 facing the foot end 56*b*. The collar bottom side 126 is preferentially perpendicular to the cylinder axis 51 or to the longitudinal coupling pin axis 120.

The coupling pin shaft 123 is configured as a circular cylinder and forms the foot end 56*b* of the coupling pin 56 on its end facing away from the coupling pin collar 122. In addition, the outer shaft area 123*a* of the coupling pin shaft 123 at the foot end 56*b* features two flat areas 127 that are radially opposite each other relative to the longitudinal coupling pin axis 120 which are used for the assembly.

The coupling pin 56 also has a recess 128 continuing from the head end 56*a* to the foot end 56*b*. As a result, the coupling pin 56 is a hollow pin. The recess preferentially 128 tapers from the head end 56*a* toward the foot end 56*b*. The recess 128 also has an inner thread 129 at the foot end 56*b*.

Figure 23:
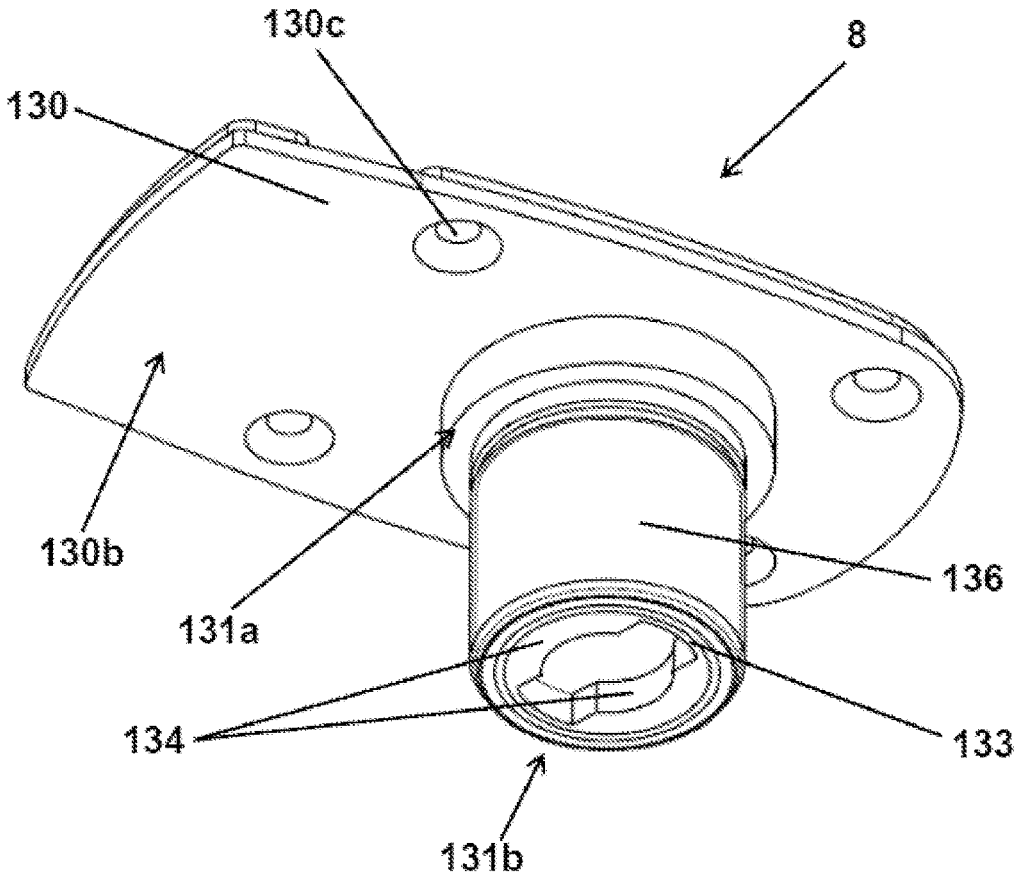
FIG. 23 is a perspective view of a cover.
Figure 24:
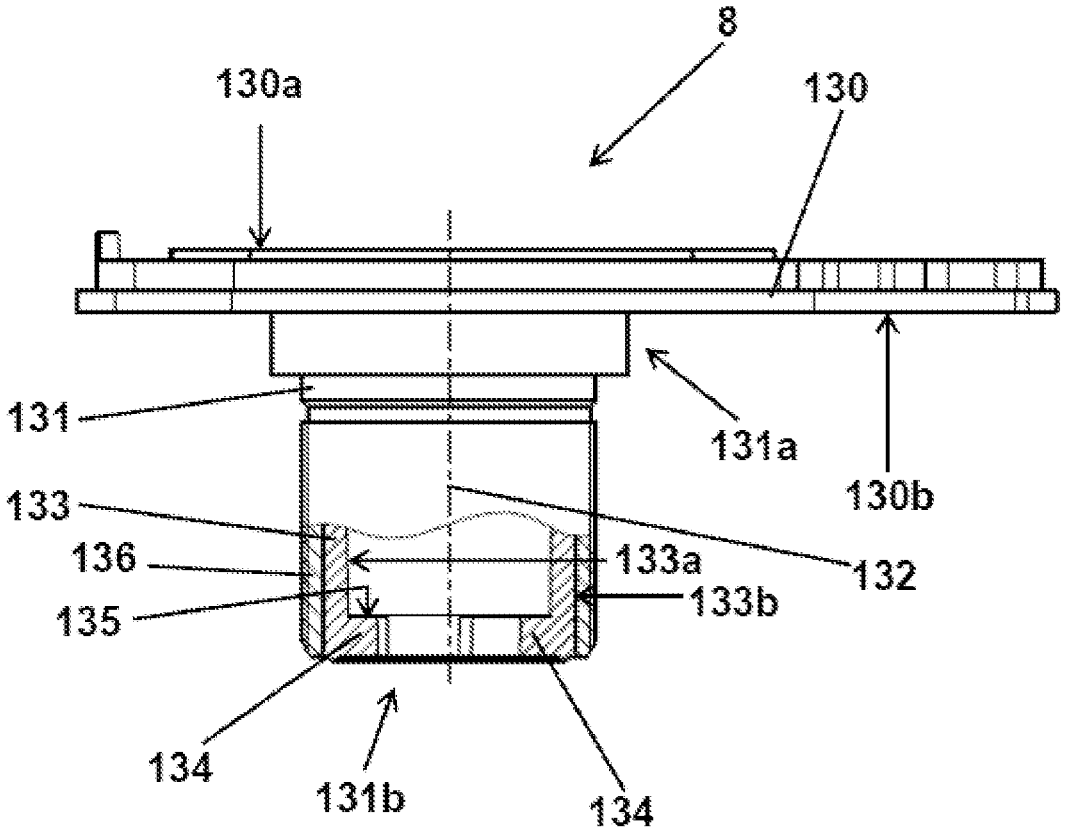
FIG. 24 is an in part sectional side view of the cover.
Figure 25:
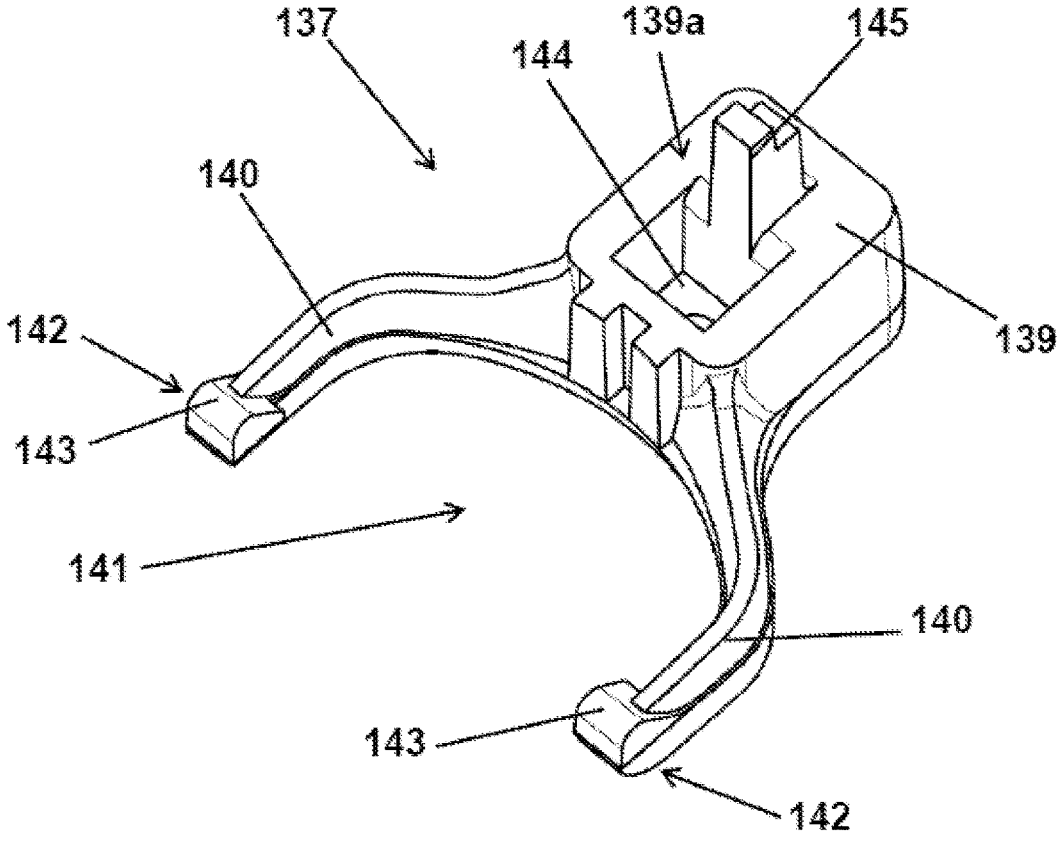
FIG. 25 is a perspective view of an actuation part of a driving fork.
Figure 26:
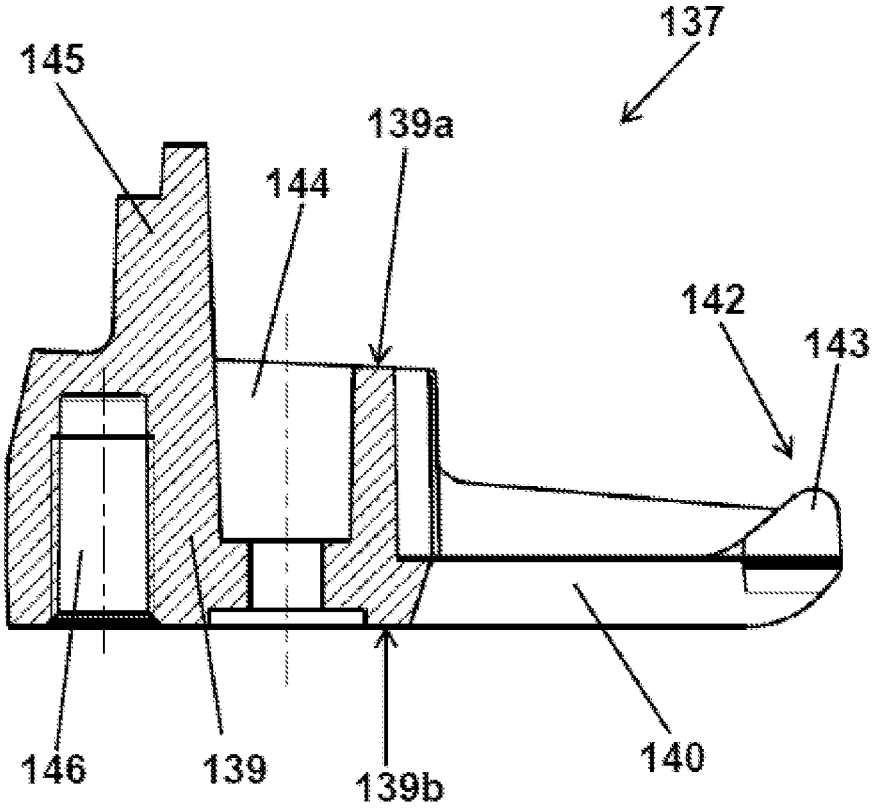
FIG. 26 is a longitudinal cross-section of the actuation part.
Figure 27:
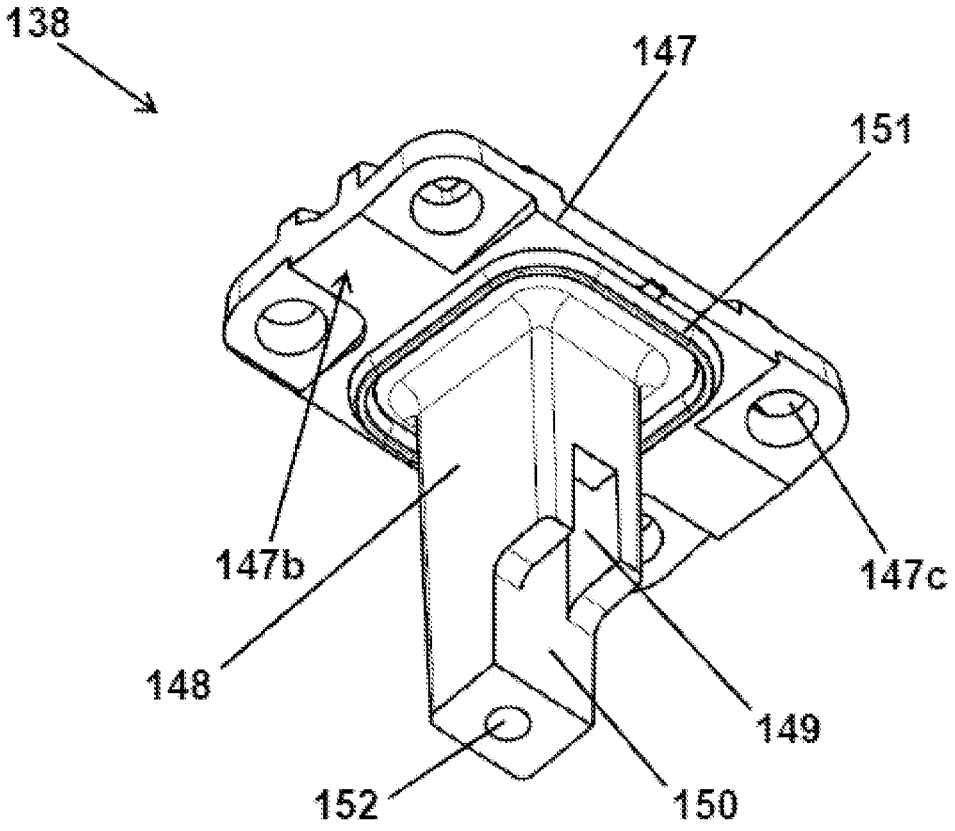
FIG. 27 is a perspective view of a coupling part of the driving fork.
Figure 28:
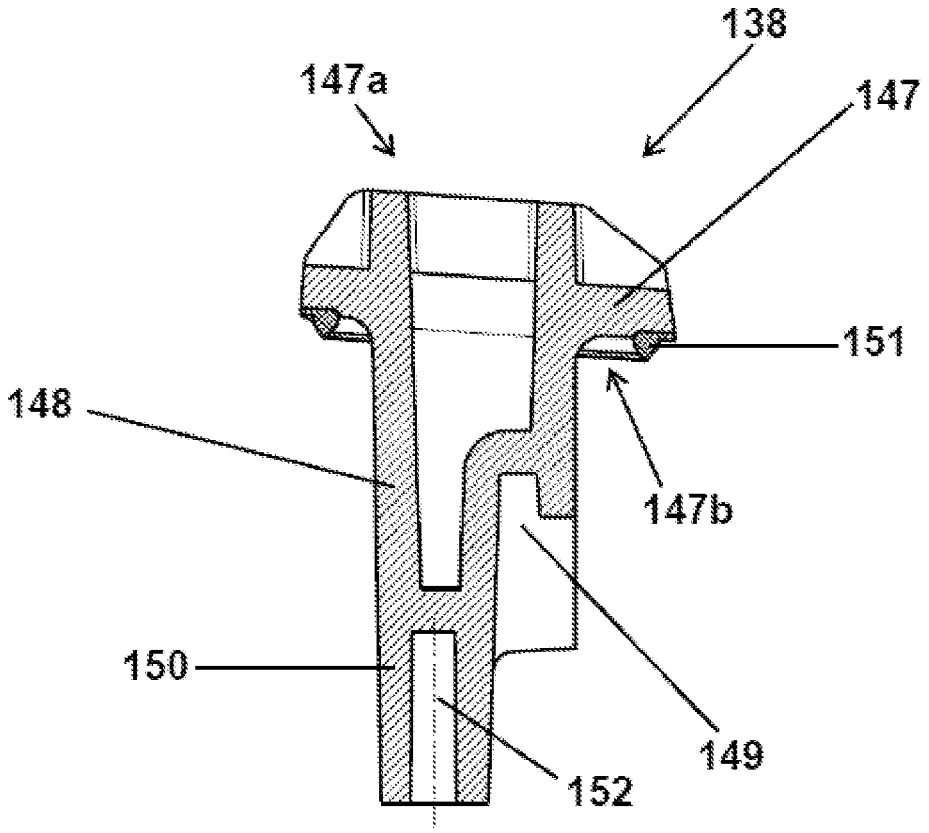
FIG. 28 is a longitudinal cross-section of the coupling part.

The cover 8 (FIGS. 23, 24) of the inventive pull handle 1 features a cover plate 130 as well as a guide bushing 131 formed thereon. The cover plate 130 and the guide bushing 131 preferentially consist of plastic. The cover plate 130 features a first, inner plate top side 130*a*, as well as an opposite outer plate top side 130*b*. In addition, the cover plate 130 has screw recesses 130*c* passing from the inner plate top side 130*a* to the outer plate top side 130*b*. The guide bushing 131 adjoins the outer plate top side 130*b* and projects therefrom. The guide bushing 131 features a guide bushing axis 132 and a guide bushing wall 133 with an inner wall area 133*a* and an outer wall area 133*b*. The diameter of the inner wall area 133*a* of the guide bushing wall 133 corresponds to the diameter of the outer wall area 100*b* of the coupling sleeve 56 in the guide region 105. The guide bushing 131 also features a first bushing end 131*a* facing the cover plate 130 and an opposite second, free bushing end 131*b*. On its free bushing end 131*b*, the guide bushing 131 has two cylindrical tube segments 134 radially opposite each other relative to the guide bushing axis 132. The cylindrical tube segments 134 adjoin the inner wall area 133*a* of the guide bushing wall 133 and project therefrom. The cylindrical tube segments 134 respectively have a preferentially level latching surface 135 facing the first bushing end 131*a*.

The cover 8 also preferentially features a threaded bushing 136 with an outer thread, which is arranged around the guide bushing 131 on the outside and molded thereon. The threaded bushing 136 consists of metal, in particular brass.

The driving fork 57 (FIGS. 25-28) is preferentially configured in two pieces and features an actuation part 138 and a coupling part 139. The actuation part 138 and the coupling part 139 are firmly connected to each other, i.e. they cannot rotate or move with respect to each other. The actuation part 138 preferentially consists of metal and has an, in particular, rectangular connection block 139 as well as two fork arms 140. The two fork arms 140 adjoin the connection block 139 and project therefrom. A receiving area 141 is formed between the fork arms 140. The two fork arms 140 feature a free actuation end 142 each. There is an actuating flange or an actuating projection 143 is available on the actuation end 142.

The connection block 139 features a first and a second block top side 139*a*, 139*b*. The connection block 139 also has a plug-in opening 144 passing from the first to the second block top side 139*a*, 139*b*, as well as a protruding plug-in element 145 projecting from the first block top side 139*a*. In addition, the connection block 139 has a threaded hole 146 with an inner thread extending from the second block top side 139*b* into the connection block 139.

The coupling part 139 preferentially consists of plastic and features a fixing plate 147 and a connection shaft 148. The fixing plate 147 features a first and second plate top side 147*a*, 147*b*, as well as screw recesses 147*c* passing from the first to the second plate top side 147*a*, 147*b*. The longitudinally configured connection shaft 148 adjoins the second plate top side 147*b* and projects therefrom. In addition, the fixing plate 147 features an annular seal 151 on the second plate top side 147*b*. The seal 151 is arranged around the connection shaft 148. On its free shaft end, the connection shaft 148 features a plug-in socket 149 corresponding to the plug-in element 145, as well as a plug-in element 150 with a threaded hole 152 with an inner thread corresponding to the plug-in opening 144. In the assembled state, the elements 144, 145, 149, 150 corresponding to each other are positively connected to each other. Furthermore, the coupling part 138 and the actuation part 137 are screwed to each other by means of a fixing screw 153, namely connected in a detachable manner. The fixing screw 153 is arranged inside the plug-in opening 144 and is screwed into the threaded hole 152. The fork arms 140 then extend transversely, in particular essentially perpendicularly, to the connection shaft 148.

In addition, the fixing plate 147 is fixed to the handle part 3, namely connected so that it cannot rotate or move, in particular, is screwed thereto.

Figure 10:
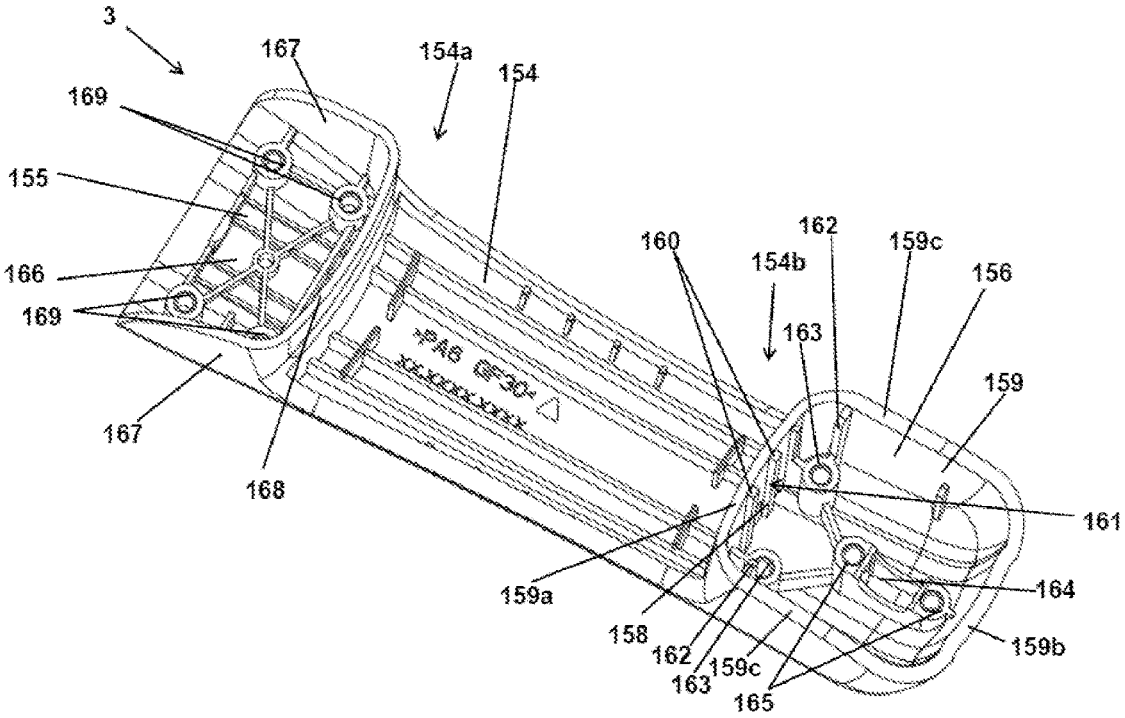
FIG. 10 is a perspective view of the handle part.

The handle part 3 (FIG. 10) preferentially consists of plastic and is preferably configured U-shaped viewed from the side of the pull handle 1. The handle part 3 features in particular a longitudinally configured handle area 154 with a first handle area end 154*a* facing the cylinder lock 13 and a handle area end 154*b* facing away from the cylinder lock 13. The handle part 3 also has an actuation area 155, which adjoins the first handle area end 154*a* and a bearing area 156, which adjoins the second handle area end 154*b*.

The handle area 154 is preferentially configured as a hollow body and preferably features a removable handle area cover 157.

The bearing area 156 is preferably beaker-shaped or cup-shaped, and has a bottom wall 158, as well as a circumferential wall 159 adjoining the bottom wall 158. The circumferential wall 159 features a front wall 159*a* facing the cylinder lock 13, a rear wall 159*b* opposite thereto, and two side walls 159*c*. The bearing area 156 is open opposite the bottom wall 158. The bottom wall 158 thus adjoins the handle area 154 as an extension. The bearing area 156 also features two ribs 160 parallel to each other, which form a bearing groove 161 between them. The ribs 160 adjoin the front wall 159*a* on the inside and project inward therefrom. Furthermore, the ribs 160 extend from the bottom wall 158 to the open end of the bearing area 156. In addition, the bearing area 156 features two bearing ribs, which likewise extend from the bottom wall 158 to the open end of the bearing area 156. A respective bearing rib 162 thus adjoins one of the two side walls 159*c* on the inside and projects inward therefrom. The bearing ribs 162 are arranged adjacent to the front wall 159*a*. Two screw domes 163 with inner threads are also available adjacent to the bearing ribs 162. The screw domes 163 adjoin the bottom wall 158 on the inside and project therefrom. There is also a bearing shell 164 available, which also has two screw domes 165 with an inner thread. The bearing shell 164 with the screw domes 165 likewise adjoins the bottom wall 158 and projects therefrom. The bearing shell 164 is arranged adjacent to the rear wall 159*b*.

The actuation area 155 also features a bottom wall 166, as well as two side walls 167 and a rear wall 168 facing the bearing area 156. The bottom wall 166 adjoins the handle area 154 as an extension therefrom. The two side walls 167 and the rear wall 168 adjoin the bottom wall 166 and project therefrom. The rear wall 168 is arranged between the two side walls 167 and is connected thereto. The two side walls 167 feature free edges 167*a* opposite the rear wall 168, which have an arc-shaped course. Furthermore, there are four screw domes 169 with inner thread available, which adjoin the bottom wall 166 on the inside and project therefrom. The screw domes 169 are used to secure the fixing plate 147, which will be explained in more detail below.

Figure 29:
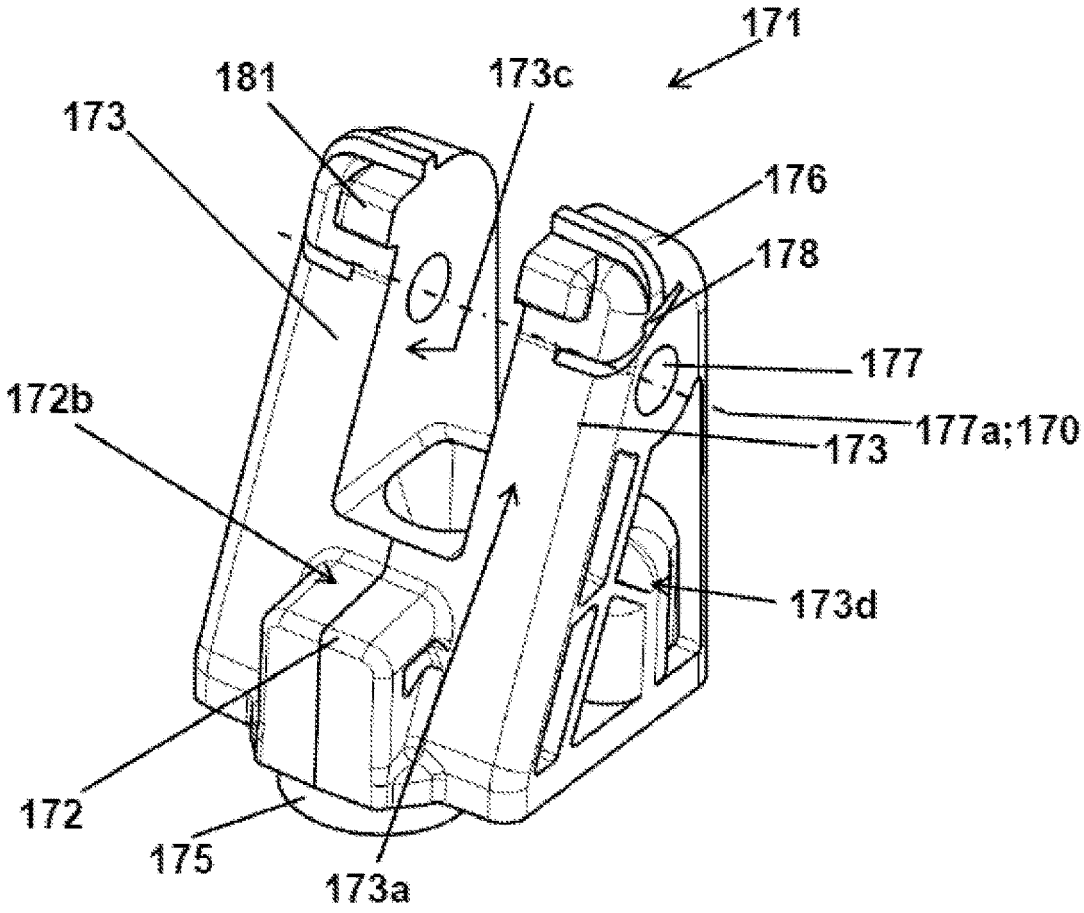
FIG. 29 is a perspective view of a bearing bracket.
Figure 30:
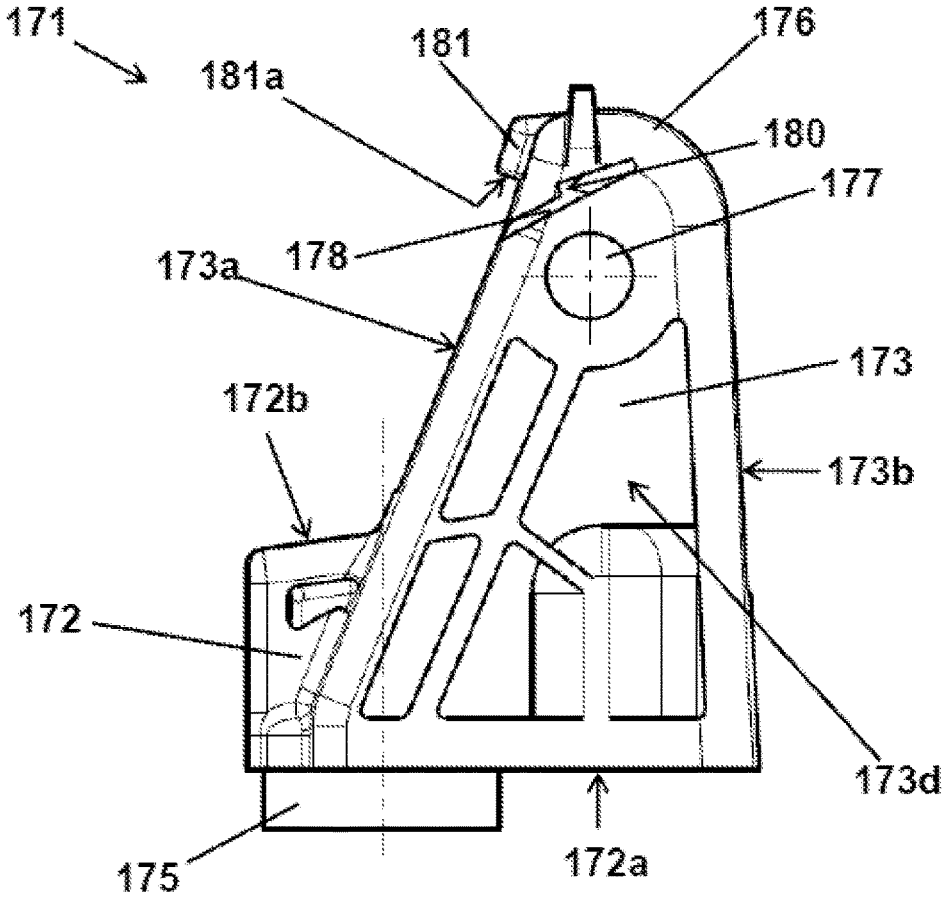
FIG. 30 is a side view of a bearing bracket.

As already explained, the handle part 3 is connected to the bearing part 2 so as to swivel around a swivel axis 170. To that end, the pull handle 1 features a bearing mounting bracket 171 (FIGS. 29, 30) preferentially consisting of plastic. The mounting bracket 171 features a fixing block 172 as well as bearing arms 173. The fixing block 172 has a block bottom side 172*a* and a block top side 172*b*. The fixing block 172 also features a threaded sleeve 174 with an inner thread preferably made of metal and molded into the fixing block 172. The treaded sleeve 174 is open toward the block bottom side 172*a* and extends from the block bottom side 172*a* to the block top side 172*b*. There is also an annular collar 175 available, which surrounds the threaded sleeve 174 and protrudes over the block bottom side 172*a*. Furthermore, the fixing block 172 features a threaded hole (not shown) which extends from the block bottom side 172*a* to the block top side 172*b* and is open toward the block bottom side 172*a*. The threaded hole is arranged adjacent to the threaded sleeve 174.

The two bearing arms 173 extend away from the block top side 172*b* and are arranged adjacent to each other. The bearing arms 173 respectively feature an arm front side 173*a*, an arm rear side 173*b* opposite thereto, as well as an inner arm side 173*c*, and an outer arm side 173*d*. The two inner arm sides 173*c* of both bearing arms 173 are facing each other, spaced apart from each other, and are preferentially level and parallel to each other. In addition, the bearing arms 173 respectively have a free arm end 176 facing away from the fixing block 172. On the free arm end 176, the bearing arms 173 respectively feature a continuous bearing recess 177 whose recess axis 177*a* is coaxial to the swivel axis 170. The two inner arm sides 173*c* are preferentially perpendicular to the recess axis 177*a*. Above the bearing recess 177, the bearing arms 173 have a spring receiving slot 178 to accommodate a leaf spring 179, which will be explained in more detail below. The spring receiving slot 178 is open toward the front arm side 173*a* and to the outer arm side 173*d* and closed toward the rear arm side 173*b* and to the inner arm side 173*c*. The spring receiving slot 178 also has a step shoulder 180.

Figure 31:
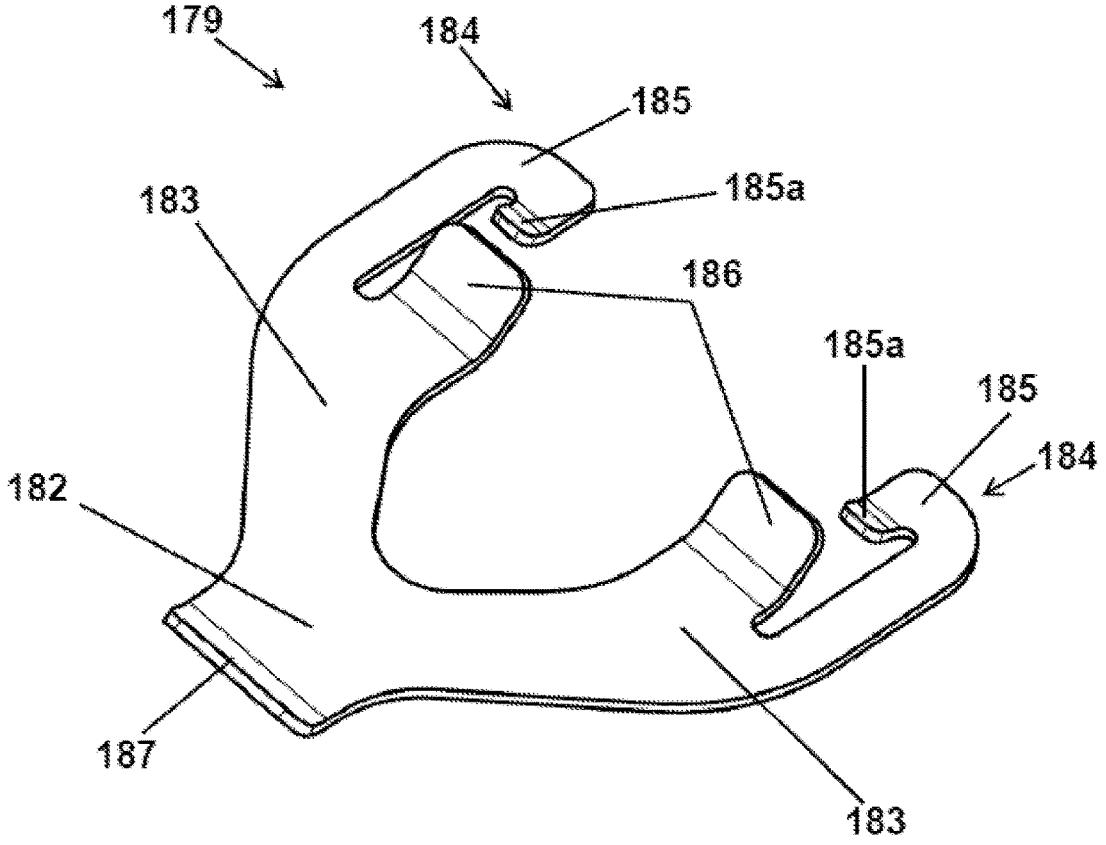
FIG. 31 is a perspective view of a leaf spring.

The two bearing arms 173 have a support trunnion 181 projecting from the front arm side 173*a*. The support trunnions 181 are arranged above the respective spring receiving slot 178 and feature a support edge 181*a* facing away from the free arm end 176. The leaf spring 179 (FIG. 31) has two spring arms 183 connected in a connection area 182. The spring arms 183 likewise form a fork, or are arranged in a fork-like manner. The leaf spring 179 also has a first and a second spring top side 179*a*, 179*b*. The spring arms 183 feature free spring arm ends 184 facing away from the connection area 182 as well as an inner arm side 183*a* and an outer arm side 183*b*. The two inner arm sides 183*a* face each other. The spring arms 183 respectively have a hook 185 on the free spring arm end 184. The hook is configured U-shaped and has a free hook end 185*a* which is preferentially bent somewhat away from the second spring top side 179*b*. The two hook ends 185*a* likewise face each other and are arranged on the inner spring side. The hooks 185 can, however, also be configured L-shaped (not shown).

Both spring arms 183 also respectively have a support bracket 186, which is arranged opposite the hook 185 and likewise on the inner side of the spring. The support bracket 186 is also preferentially somewhat bent away from the second spring top side 179*b*. A free end 187 of the connection area 182 opposite the spring arms 183 is also preferentially somewhat bent away from the second spring top side 179*b*.

Figure 32:
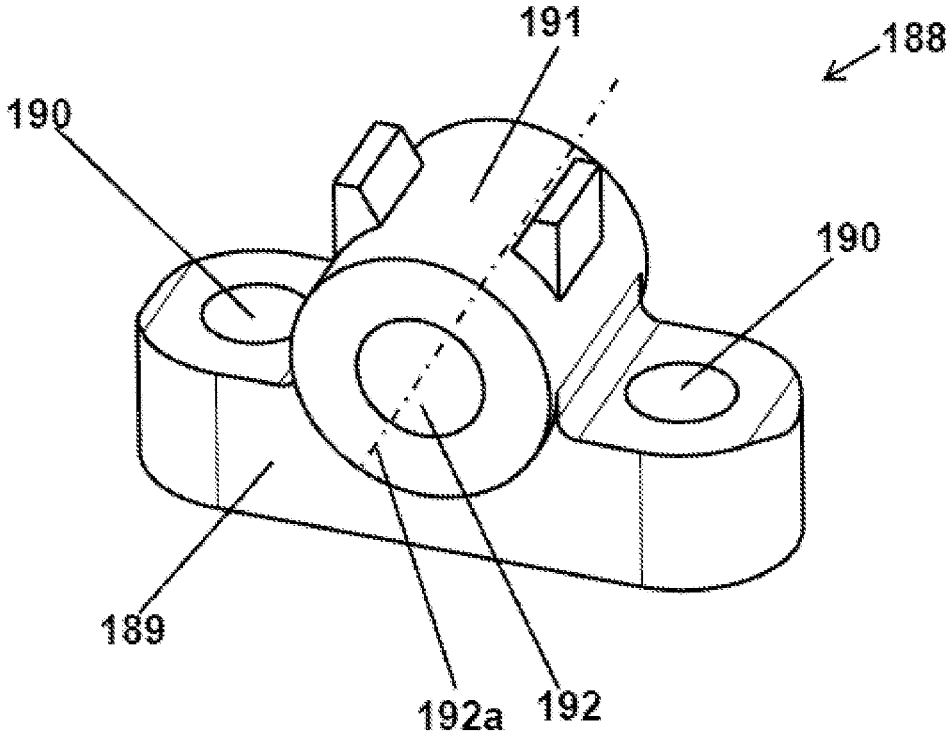
FIG. 32 is a perspective view of a bearing.

For mounting the handle part 3 rotatable around the swivel axis 170 the pull handle 1 features a bearing 188 (FIG. 32) preferentially consisting of plastic. The bearing 188 has an elongated base body 189 with two continuous recesses 190, as well as a bearing sleeve 191 with a continuous bearing recess 192. A recess axis 192*a* of the bearing recess 192 is coaxial to the swivel axis 170. The bearing recess 192 is used to receive an axle bolt 193, which will be explained in more detail below.

Figure 33:
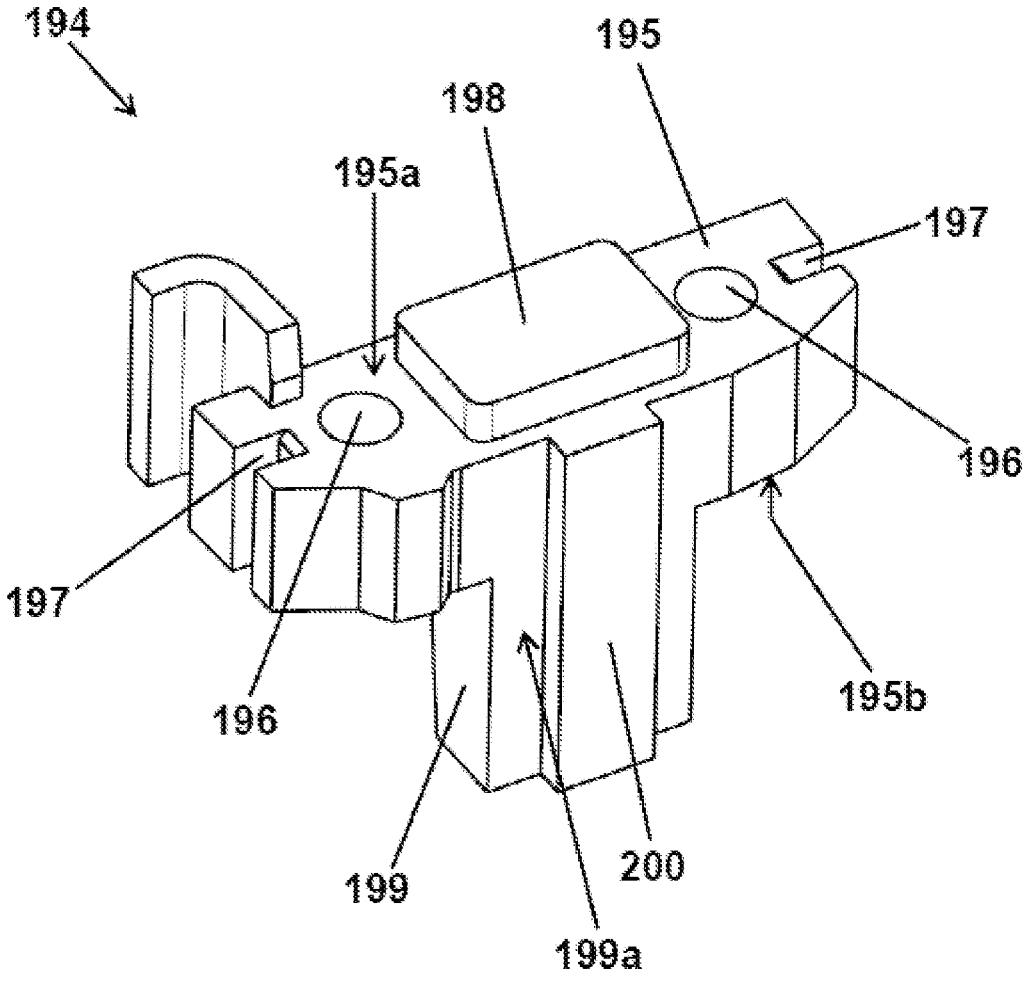
FIG. 33 is a perspective view of a spring compressor.

Furthermore, the pull handle 1 features a spring compressor 194 (FIG. 33) preferentially consisting of plastic. The spring compressor 194 features an elongated base body 195 with a first and second body top side 195*a*, 195*b*. The base body 195 has two recesses 196 respectively passing from the first to the second base body top side 195*a*, 195*b*. On both its free ends, the base body 195 also has a slot 197 passing from the first to the second base body top side 195*a*, 195*b*. In addition, the spring compressor 194 features a contact plate 198, which is arranged on the first base body top side 195*a* and projects therefrom.

The spring compressor 194 also has a bar 199 which projects from the second base body top side 195*b*. The bar 199 is arranged in the center relative to the longitudinal extension of the base body 195. The bar 199 also features a strip 200 on a rear bar side 199*a* facing away from the base body 195.

The assembled pull handle 1 will now be explained in the following section: In the assembled state of the pull handle 1 (FIGS. 2 and 3), the cover 8 is firmly connected to the bearing housing 7, namely, so that it cannot rotate or move, but in a detachable manner, in particular screwed. The screws used for this purpose (not shown) thereby engage through the four screw recesses 130*c* of the cover plate 130 of the cover 8 and are screwed into the screw domes 201 with inner thread, which are molded onto the housing bottom 11 of the bearing housing 7. The cover plate 130 of the cover 8 covers or closes the bearing housing 7 at its open end. The cover plate 130 thereby adjoins the second plate end 6*d* of the base plate 6 and is arranged as an extension thereof. The inner plate top side 130*a* of the cover plate 130 faces the bearing housing 7. As a result, the guide bushing 131 of the cover 8 is arranged outside the bearing housing 7. The guide bushing 131 in particular points away from the bearing housing 7.

As already explained above, the locking cylinder 24 is mounted in the bearing housing 7, in particular in the bearing bushing 18 so that it cannot move or rotate. The locking cylinder is preferably molded into the bearing bushing 18. The locking cylinder 24 thereby rests on the first circular cylindrical inner area section 23 and the conical inner area section 25 of the inner bushing wall area 22 of the bearing bushing 18. The cylindrical axis 51 is thereby coaxial to the bearing bushing axis 19.

The cylinder core 48 is, as likewise already explained above, mounted in the locking cylinder 24 so that it cannot be axially moved but rotated around the cylinder axis 51 after inserting a matching key.

The adapter pin head 59 of the adapter pin 52 rests with its head bottom side 59*b* on the second annular area 29 of the inner bushing wall area 22 of the bearing bushing 18. As a result, the adapter pin head 59 is clamped between the second annular area 29 and the cylinder core 48 in the axial direction. The head edge area 62 of the adapter pin head 59 of the adapter pin 52 is arranged inside the third circular cylindrical inner area section 28 of the inner bushing wall area 22 of the bearing bushing 18. The adapter pin collar 60 of the adapter pin 52 is positively arranged inside the fourth circular cylindrical inner area section 30 of inner bushing wall area 22 of the bearing housing 18 and inside the through opening 31 of the bearing bushing 18. The adapter pin 52 thus cannot move in the axial direction but rotate in the bearing bushing 18 around the longitudinal adapter pin axis 58 and the cylinder axis 51. The drive pin 64 of the cylinder core 48 also positively engages in the drive slot 63 of the adapter pin 52. As a result, the adapter pin 52 with the cylinder core 48 cannot rotate around the cylinder axis 51 when connected. Or, the adapter pin 52 is connected with the cylinder core 48 so that it can be driven in a rotary manner around the cylinder axis 51.

Furthermore, the adapter pin 52 engages through the through opening 31 of the bearing bushing 18. The driving ribs 67 and the adapter pin shaft 61 of the adapter pin 52 are thus arranged outside the bearing bushing 18. The adapter pin head 59 and the adapter pin collar 60 are arranged inside the bearing bushing 18.

The actuator sleeve 53 is connected to the adapter pin 52 so that it cannot be rotated around the cylinder axis 51. Or, the actuator sleeve 53 is connected to the adapter pin 52 so that is can be can be driven in a rotary manner around the cylinder axis 51. Or, the actuator sleeve 53 is connected via the adapter pin 52 to the cylinder core 48 so that it can be driven in a rotary manner around the cylinder axis 51. The adapter pin 52 thus is used to transfer the rotary movement of the cylinder core 48 to the actuator sleeve 53 without delay or free-wheel. To that end, the adapter pin shaft 61 of the adapter pin 52 is arranged in the area of the drive ribs 67 inside the sleeve recess 74 of the actuator sleeve 53. The inner shaft wall area 75*a* of the shaft wall 75 of the actuator sleeve 53 surrounds the adapter pin shaft 61 and the drive ribs 67 in a positive locking manner. The remaining part of the adapter pin shaft 61 protrudes from the actuator sleeve 53. The disk top side 72*a* of the head disk 72 of the actuator sleeve 53 also rests on the contact area 35 of the bushing wall bottom area 32 of the bearing bushing 18.

The actuator sleeve 53 is also connected to the torsion spring 41. The torsion spring 41 is pre-tensioned in the initial position, or 0 position of the actuator sleeve 53. The initial position corresponds to the position of the actuator sleeve 53 in the initial position or 0 position of the cylinder core 48. To that end, the torsion spring 41 is arranged around the outer shaft wall area 75*b* of the shaft wall 75 of the actuator sleeve 53 and is supported on one end on the spring pin 82 of the actuator sleeve 53 and on the other end on the spring pin 40 of the bearing bushing 18. If the actuator sleeve 53 rotates around the cylinder axis 51, regardless of the direction, the torsion spring 41 is further tensioned and drives the actuator sleeve 53 back to its initial position against the deflection direction. That is to say, the torsion spring 41 has to rotate the actuator sleeve 53 against the respective deflection direction. As a result, after deflection, the torsion spring 41 drives the actuator sleeve 53 against the respective deflection direction relative to the bearing housing 7.

The latching sleeve 54 with the latching sleeve wall 83 is arranged around the sleeve shaft 73 of the actuator sleeve 53. In this way, the two guide areas 79 of the actuator sleeve 53 rest on the inner wall area 85 of the latching sleeve wall 83. And the first guide areas 78 of the actuator sleeve 53 rest on the inner rib areas 95 of the drive ribs 94 of the latching sleeve 54. The shaft end area 81 of the sleeve shaft 73 of the actuator sleeve 53 also rests on the first annular collar surface 88*a* of the annular collar 88 of the latching sleeve 54. And the adapter pin 52 engages through the latching sleeve wall 83 and protrudes over the second wall end area 83*b* and projects from the latching sleeve 54.

The first actuation areas 80*a* of the actuator sleeve 53 also rest on the first rib edges 96*a* of the drive ribs 94 of the latching sleeve 54. As a result, the latching sleeve 54 is connected to the actuator sleeve 53 so that it can be driven in a rotary manner around the cylinder axis 51 in the locking direction 202. A rotary movement of the actuator sleeve 53 in the locking direction 202 is directly and immediately transferred to the latching sleeve 54, namely without delay or play.

In addition, the detents 92 of the latching arms 90 of the latching sleeve 54 are respectively arranged in a locking depression 37, engaged therein. This is effected by a second torsion spring 97. The second torsion spring 97 is arranged around the adapter pin shaft 61 and is supported on one end on the second annular collar surface 88*b* facing away from the actuator sleeve 53 and on the other end on a supporting ring 203. The supporting ring 203 is adjacent to the foot end 52*b* of the adapter pin 52 and arranged around the adapter pin shaft 61 and axially connected non-displaceable thereto. The second torsion spring 97 presses the latching sleeve 54 in the direction of the bearing bushing 18. The latching sleeve 54 is thus connected to the second torsion spring 97 so that it can be driven in the actuation direction 204 parallel to the cylinder axis 51. As a result, the detents 92 of the latching sleeve 54 are pressed into the locking depressions 37. Because of this, the latching sleeve 54 can only be rotated around the cylinder axis 51 against the force of the second torsion spring 97.

In the non-actuated condition (FIG. 2), namely when the handle part 3 is not actuated, the latching sleeve 54 is also arranged in the bearing section 103 of the coupling sleeve 55. The two latching arms 90 of the latching sleeve 54 are thereby respectively arranged between two ribs 112 of the coupling sleeve 55. The slide areas 91 of the latching arms 90 rest on the ribs 112. The latching sleeve 54 thereby is arranged in the area of the first rib ends 112*a* of the ribs 112. The coupling sleeve 55 is thus connected non-rotatable to the latching sleeve 54 around the cylinder axis 51. Or, the coupling sleeve 55 is connected to the latching sleeve 54 so that it can be driven in a rotary manner around the cylinder axis 51. The coupling sleeve 55 can, however, be displaced in the axial direction, namely parallel to the cylinder axis 51, by a limited amount relative to the latching sleeve 54.

The coupling sleeve 55 can be displaced in a direction parallel to the cylinder axis 51 and is mounted in a bearing part 2, in particular in the bearing housing 7, so that it can be rotated around the cylinder axis 51. To that end, the bearing section 103 of the coupling sleeve 55 is guided in the bearing sleeve 42 of the bearing housing 7. In particular the outer wall area 100*b* of the coupling sleeve wall 100 rests on the guide ribs 47 in the region of the bearing section 103. In addition, the guide section 105 of the coupling sleeve 55 is arranged inside the guide bushing 131 of the cover 8. The outer wall area 100*b* of the coupling sleeve wall 100 rests on the inner wall areas 133*a* of the guide sleeve wall 133 in the area of the guide section 105. The coupling sleeve 55 is thus displaceable in the cover 8 parallel to the cylinder axis 51 and is mounted so that it can be rotated around the cylinder axis 51. In the non-actuated initial position, the second end area 102 of the coupling sleeve wall 100 thereby rests on both latching surfaces 135 of the guide bushing 131 of the cover 8. The coupling sleeve 55 thus does not protrude from the cover 8.

In this non-actuated position, the coupling sleeve 55 is pressed by the first torsion spring 114. The first torsion spring 114 is arranged around the bearing bushing 18 and rests in particular on the outer bushing wall area 21. The first torsion spring 114 is thus arranged in the annular gap 45. On one end the torsion spring 114 is thereby supported on the latching surface 46 of the housing bottom 11. On the other end the first torsion spring 114 is supported on the ribs 112, in particular on the first rib end 112*a*. For this purpose, the first torsion spring 114 is arranged in the receiving trough 113 of the ribs 112. As a result, the first torsion spring 114 presses the coupling sleeve 55 away from the housing bottom 11 in the direction of the cover 8 to its non-actuated position. The coupling sleeve 55 is thus connected to the first torsion spring 114 and can be driven against the actuation direction 204.

The coupling pin 56 is mounted non-displaceable in the coupling sleeve 55 in an axial parallel direction to the longitudinal coupling pin axis 120 but can be freely rotated around the longitudinal coupling pin axis 120. In particular, the coupling pin 56 with the coupling pin head 121 and the coupling pin collar 122 is arranged inside the guide section 105 of the coupling sleeve 55. To that end, the coupling pin 56 with the collar bottom side 126 rests on the first shoulder area 118*a* of the bearing shoulder 117 of the coupling sleeve 55. There is also a clamp ring 205 available, which secures the coupling pin 56 in the axial direction. The coupling pin shaft 123 thereby protrudes from the coupling sleeve 55 at the second coupling sleeve end 55*b*. Furthermore, the coupling pin 56 also protrudes in the non-actuated state of the handle part 3 (FIG. 2) from the guide bushing 131 at the second bushing end 131*b*, namely from the pull handle housing 1*a*. As a result, the coupling pin 56 can be connected to the actuation mechanism of a lock. The coupling pin 56 is thus used to connect to the coupling elements of lock mechanisms, which are arranged outside the pull handle housing 1*a*.

As already explained above, the driving fork 57 is configured in two parts. In the assembled state, the actuation part 138 and the coupling part 139 are firmly connected to each other. The driving fork 57 is also firmly connected to the handle part 3. For that purpose, there are four securing screws 76 available, which engage through the screw recesses 147*c* and are screwed into the screw domes 169. The connecting shaft 148 then projects from the bottom wall 166 of the actuation area 155 of the handle part 3. The connection shaft 148 engages through the second housing opening 16. In this way, the seal 151 rests on the outer shoulder area 15 of the stepped shoulder 14 of the bearing housing 7.

The two fork arms 140 of the driving fork 57 arranged inside the bearing housing 7 and outside the coupling sleeve 55, in particular the bearing area 103, encompass the coupling sleeve 55. The coupling sleeve 55 is thus arranged in the receiving area 141. The actuation projections 143 of the fork arms 140 respectively rest on the coupling areas 107 of one of the coupling pins 106 of the coupling sleeve 55. As a result, the coupling sleeve 55 is connected to the handle part 3 and can be driven by the driving fork 57 into the actuation direction 204.

Figure 34:
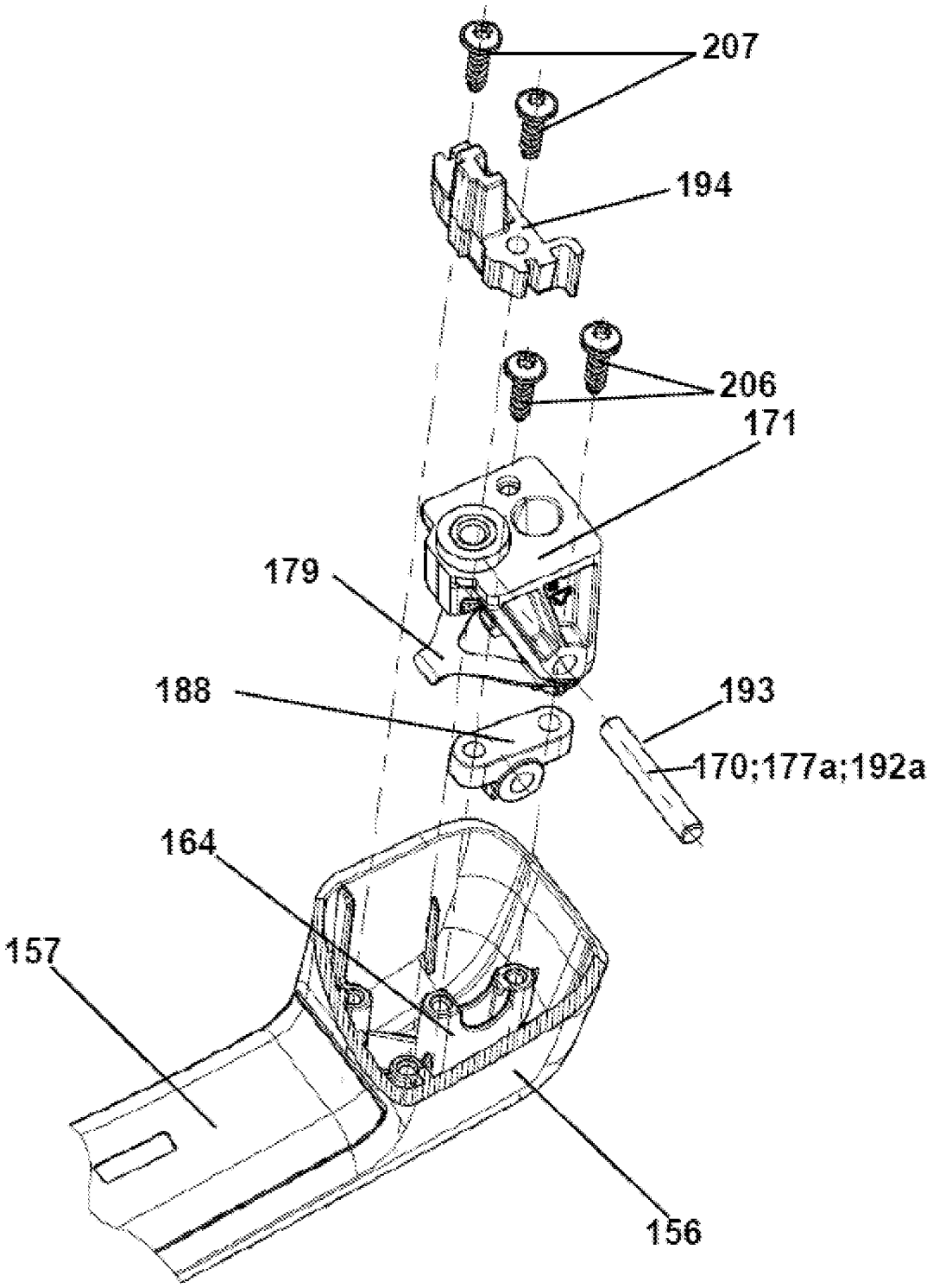
FIG. 34 is a perspective exploded representation of the bearing means of the inventive pull handle.

As already explained, the handle part 3 can swivel around the swivel axis 140 with the bearing part 2, in particular, be connected to the base plate 6 (FIGS. 2, 3 and 34). For that purpose, the bearing 188 is firmly connected to the bottom wall 158 of the bearing area 156 of the handle part 3, in particular by screwing. Securing screws 206 engage through the recesses 190 of the bearing 188 and are screwed into the screw domes 165 of the bearing shell 164. The axle bolt 193 is arranged in the bearing recess 192 of the bearing 188. The axle bolt 193 is also arranged in both bearing recesses 177 of the bearing arms 173 of the mounting bracket 171. The bearing 188 is thereby arranged between the two bearing arms 173. The mounting bracket 171 is furthermore firmly connected to the base plate 6. For that purpose, there is a securing screw (not shown) available which engages through a recess in the base plate 6 and is screwed into an inner thread of the fixing block 172. The two bearing arms 173 are thus spaced apart from the base plate 6.

The threaded sleeve 174 of the mounting bracket 171 thereby engages through a recess in the base plate 6 so that it is accessible from the second base plate top side 6*b*, or is open toward the second base plate top side 6*b*. As a result, the mounting bracket 171 can be secured by means of another securing screw (not shown) to a vehicle door made of metal, glass, or plastic. The securing screw thereby engages through an opening in the vehicle door. A rubber pad is arranged, in a manner known per se, on the inner side of the door between the vehicle door and the pull handle 1 as a seal, and a lining sheet, both of which are likewise engaged by the securing screw. The lining sheet intended to distribute the force. The door lock is also secured to the lining sheet in the usual manner.

As a result, at least part of the forces of the leaf spring 179 is transferred to the vehicle door. The base plate 6 is thus relieved. In addition, the forces, which arise when the handle part 3 is pulled, are guided at least in part directly to the vehicle door via the other securing screw, that is to say, not via the base plate 6.

Furthermore, the leaf spring 179 is supported with the end of the connection area 187 on the spring compressor 194, in particular the first base body top side 195*a*. For that purpose, the spring compressor 194 is arranged with the strip 200 in the bearing groove 161 of the bearing area 156 of the handle part 3. In addition, the ribs 160 of the bearing area 156 are arranged in the slots 197 of the spring compressor 197. The first base body top side 195*a* points to the bottom wall 158 of the bearing area 156. Securing screws 207 engage through the recesses 196 of the spring compressor 194 and are screwed into the screw domes 163. The spring compressor 194 is thus firmly connected to the bearing areas 156, namely, it cannot be displaced or rotated.

Furthermore, the leaf spring 179 is supported in the area of both spring arm ends 184 on both bearing arms 143. In particular, the spring arm ends 184 are respectively arranged in one of the two spring receiving slots 178. The support brackets 186 of the leaf spring 179 rest on the support edges 181*a*. As a result, the handle part 3 is connected to the leaf spring 179 so that it can be driven in a rotary manner around the swivel axis 170 against the handle actuation direction 208. The leaf spring 179 pushes the handle part 3 to its non-actuated position.

If the pull handle 1 is secured on the vehicle door or lift gate, the guide bushing 131 with the threaded bushing 136 arranged thereon engages through an opening in the vehicle door. A nut is also screwed on the threaded bushing 136, so that the pull handle 1 is secured in a clamped manner on the vehicle door. As described above, a seal and a lining sheet, which are also engaged by the threaded bushing 136, are also available between the nut and the vehicle door. This fixing method is especially appropriate for a glass door. The reason is that only one large opening is required in the glass plate, not several. Openings in glass plates are not easy and critical to produce, so that a single large opening is very advantageous.

The functioning of the inventive pull handle will be explained in more detail below:

In order to actuate the lock mechanics of the respective lock, an operator pulls the handle part 3 so that it is swiveled around the swivel axis 170 in the handle actuation direction 208 (FIG. 2) against the force of the leaf spring 179 relative to the bearing part 2 from its non-actuated (FIG. 2) to its actuated position (FIG. 3). As a result, the driving fork 57 is also swiveled in the handle actuation direction 208. In this way, the actuation projections 143 of the fork arms 140 move toward the bottom wall 11 of the bearing housing 7. The actuation projections 143 thus proportionally move in the actuation direction 204. Since the actuation projections 143 rest on the coupling areas 107 of the coupling pins 106, the coupling sleeve 55 is taken along by the actuation projections 143 in the actuation direction 204. The actuation projections 143 thereby slide along the coupling surfaces 107 of the coupling pins 106. The rotary movement of the driving fork 57 thus causes a linear movement of the coupling sleeve 55 in the actuation direction 204 parallel to the cylinder axis 51 against the force of the first torsion spring 114. The cylinder axis 51 thus represents an actuation axis 209 of the actuating mechanism 4 and is coaxial thereto. The bearing area 103 of the coupling sleeve 55 is thereby guided into the bearing sleeve 42. The coupling sleeve 55 can thus be displaced in the actuation direction 204 relative to the bearing housing 7 until the first end area 101 of the coupling sleeve 55 stops on the latching face 46 of the housing bottom 11.

During the movement of the coupling sleeve 55, the latching arms 90 of the latching sleeve 54 slide into the guide slots 108 of the coupling sleeve 55. In the actuated state of the handle part 3, the latching arms 90 are arranged in the guide section 105 of the coupling sleeve 55. The latching surfaces 98 of the latching arms 90 preferentially rest on the second slot end edges 110*b*. Since the coupling pin 56 is connected non-displaceable to the coupling sleeve 55, it is taken along by the coupling sleeve 55 and displaced in the actuation direction 204. The linear movement of the coupling pin 56 then results in the actuation of the respective lock mechanics.

Upon release of the handle part 3, it swivels driven by the force of the leaf spring 179, against the handle actuation direction 208, back to its non-actuated position (FIG. 2). The coupling sleeve 55 also moves driven by the force of the first torsion spring 114, against the actuation direction 204, back to its non-actuated position.

The functioning described above applies to an unblocked or unlocked pull handle 1, when the lock mechanism, especially the cylinder lock 13, is in the unblocked or unlocked position or initial position. If the pull handle 1 is now blocked, the operator inserts a matching key into the cylinder core 48 so that the disc tumblers 49 are retracted.

Subsequently, the lock is rotated in the locking direction 202 (FIG. 4) around the cylinder axis 51, which causes a rotation of the cylinder core 48 in the locking direction 202. A rotation of the cylinder core 48 causes a rotation of the adapter pin 52 around the cylinder axis 51 in the locking direction 202. The adapter pin 52 in turn drives the actuator sleeve 53 in the locking direction 202 without delay. Since the first actuation areas 80*a* of the actuator sleeve 53 rest on the first rib edges 96*a* of the driving ribs 94 of the latching sleeve 54, the latching sleeve 54 is also by the actuator sleeve 53 in the locking direction 202 driven without delay. In this way, the detents 92 of the coupling sleeve 55 are pressed out of the locking depressions 37 against the force of the second torsion spring 97 and latch into the locking depressions 37 adjacent thereto after the rotation.

The cylinder core 48, the adapter pin 52, the actuator sleeve 53 and the latching sleeve 54 are then in their locked position.

Figure 5:
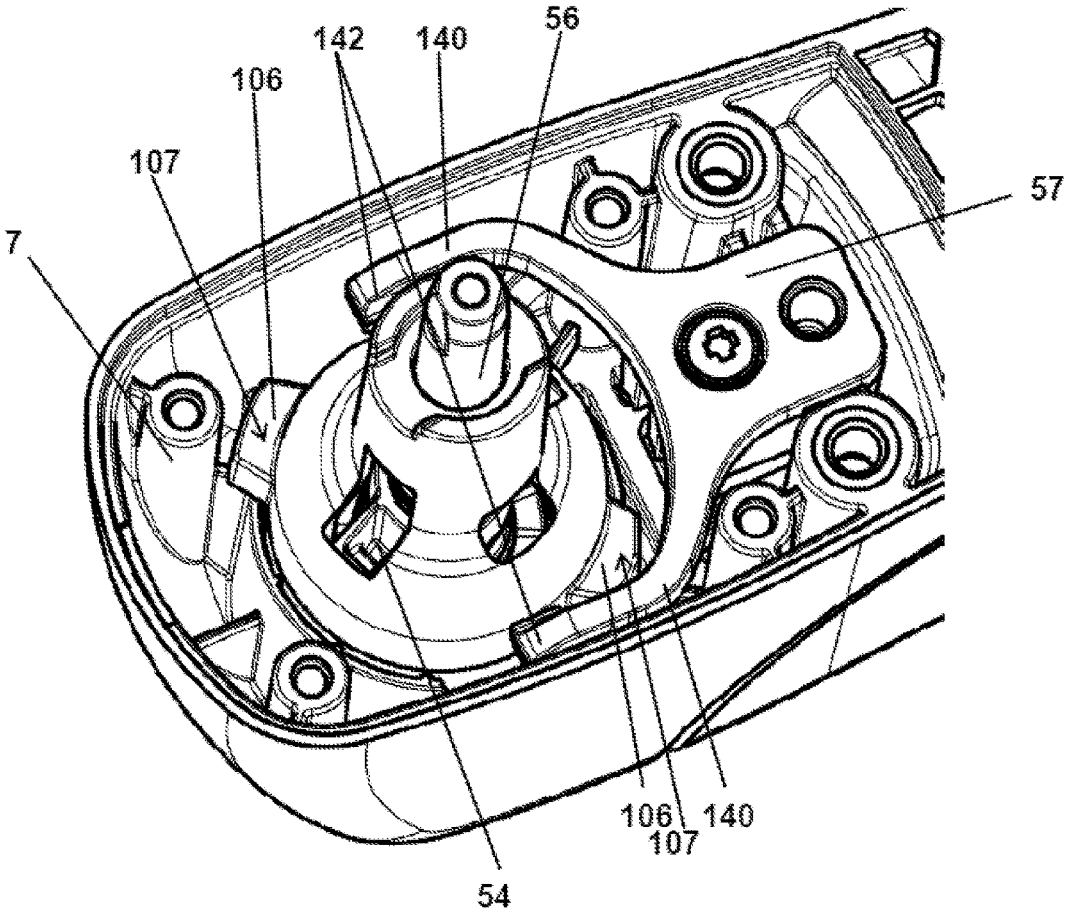
FIG. 5 is a top view of part of the actuation mechanism in the uncoupled or locked and actuated position.
Figure 6:
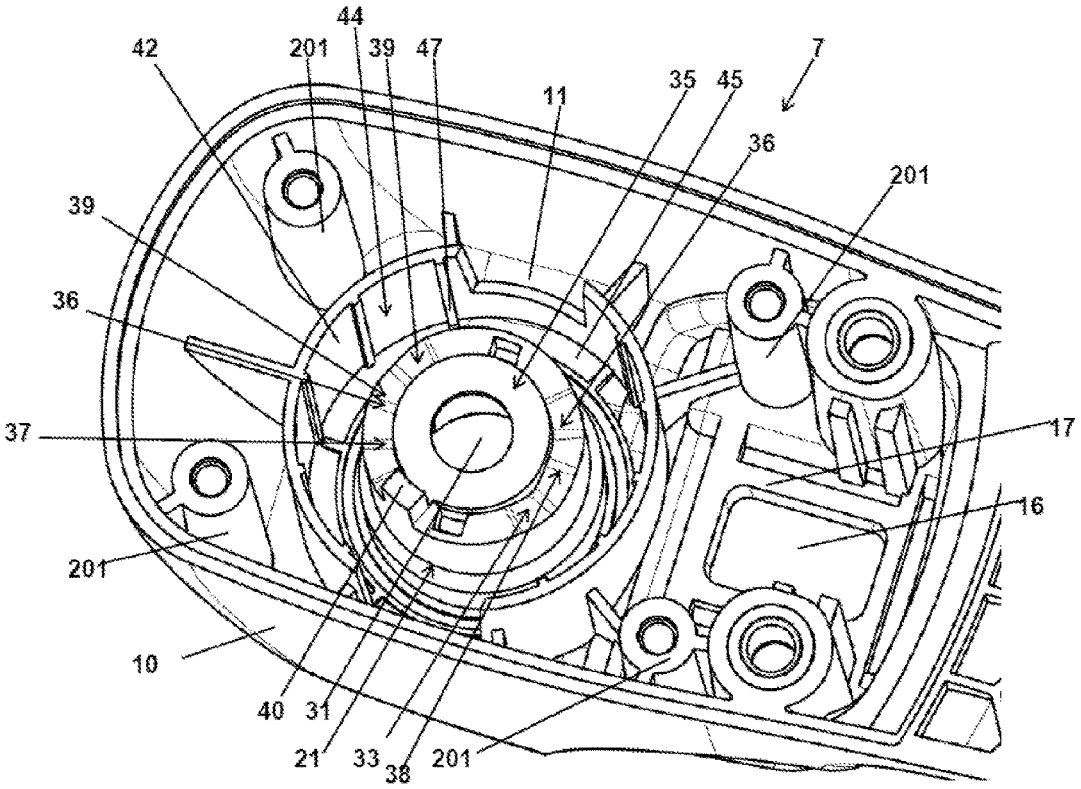
FIG. 6 is a view of the bearing housing of a bearing part from the open side.

The latching sleeve 55 again drives the coupling sleeve 55 in the locking direction 202 without delay. In this way, the coupling pins 106 are rotated such that they no longer are arranged aligned in the direction of the cylinder axis 51 toward the actuation projections 143 of the fork arms 140 (FIG. 5). As a result, the driving fork 57 and the coupling sleeve 55 are mechanically decoupled from each other. The coupling sleeve 55 is in its decoupled position. A rotary movement of the driving fork 57 in the handle actuation direction 208 no longer causes a movement of the coupling sleeve 55. A no-load stroke of the handle part 3 occurs. The lock mechanics are not actuated.

If the key is released, the actuator sleeve 53 rotates back against the locking direction 202 to its original position driven by the force of the torsion spring 41. The actuator spring 53 also drives the adapter pin 52 and in addition the cylinder core 48 against the locking direction 202. They also return to their original position.

The latching sleeve 54 is, however, not taken along in the locking direction 202 by the actuator sleeve 53 because of the above-described free-wheel between the latching sleeve 54 and the actuator sleeve 53. In particular, the actuator sleeve 53 can be rotated relative to the latching sleeve 54 so far opposite the locking direction 202 until the second actuation areas 80*b* of the actuator sleeve 53 rest on the second rib edges 96*b* of the driving ribs 94 of the latching sleeve 54.

The latching sleeve 54 and the coupling sleeve 55 thus remain in their locked position or decoupled position. If the key is again inserted and rotated in the locking direction 202, the cylinder core 48, the adapter pin 52 and the actuator sleeve 53 are rotated in the locking direction 202, but the latching sleeve 54 and the coupling sleeve 55 are not moved again. The actuator sleeve 53 only swivels relative to the latching sleeve 54 until the first actuation areas 80*a* of the actuator sleeve 53 again rest on the first rib edges 96*a* of the driving ribs 94 of the latching sleeve 54.

If it again should be unblocked or opened or coupled, the key is rotated by the operator against the locking direction 202. As a result, the cylinder core 48, the adapter pin 52, and the actuator sleeve 53 are rotated against the locking direction 202. Since the second actuation areas 80*b* of the actuator sleeve 53 rest on the second rib edges 96*b* of the driving ribs 94 of the latching sleeve 54, the latching sleeve 54 is again driven by the actuator sleeve 53 against the locking direction 202 without delay. In this way, the detents 92 of the latching sleeve 55 are again pushed out of the locking recesses 37 against the force of the second torsion spring 97 and engage into the locking recesses 37 adjacent thereto after rotation. The coupling sleeve 55 is taken along by the latching sleeve 54 and swiveled into its coupled position. After the key is released, the actuator sleeve 53 rotates driven by the force of the torsion spring 41 in the locking direction 202 back to its initial position. The actuator sleeve 53 also drives the adapter pin 52 and in addition the cylinder core 48 in the locking direction 202. They also return to their initial position. Now all parts are again in their original position.

If the key is now again inserted and rotated unintentionally against the locking direction 202, the cylinder core 48, the adapter pin 52 and the actuator sleeve 53 are rotated against the locking direction, but the latching sleeve 54 and the coupling sleeve 55, however, are not moved again because of the free-wheel. The actuator sleeve 53 only swivels relative to the latching sleeve 54 until the second actuation areas 80*b* of the actuator sleeve 53 rests on the second rib edges 96*b* of the driving ribs 94 of the latching sleeve 54.

Because of the free-wheel, the lock mechanism 5 thus features a pulse switching. Impulse switching means that the key is rotated to unlock and lock the cylinder lock 13 but returns independently to its initial position after being released, especially by means of the spring force, wherein the locking or unlocking of the actuation mechanism 4 is, however, preserved. That is to say, the functionality status or the functional status does not change, regardless of whether the actuation mechanism 4 is operational or not operational.

The advantage of the inventive pull handle is that the coupling pin, which is used to unlock the lock to be coupled with coupling elements located outside the pull handle housing, executes a linear movement and can freely rotate around the actuation axis. As a result, a connection to other coupling elements is definitely simpler and the wear at the coupling site is definitely lower. It is naturally understood in the context of the invention that an element with a different shape can be used as the coupling element instead of the pin.

While the above description constitutes the preferred embodiment of the present invention, it will be appreciated that the invention is susceptible to modification, variation and change without departing from the proper scope and fair meaning of the accompanying claims.

The invention claimed is:

1. A pull handle (1) to unlock a lock of a door or lift-gate, for a vehicle including a construction machine or an agricultural vehicle, comprising:

a pull handle housing (1*a*) having a bearing part (2) for securing on the door or lift gate and a handle part (3) connected to the bearing part (2) so as to swivel around a swivel axis (170), wherein the handle part (3) can be swiveled by pulling it from a non-actuated to an actuated position, an actuation mechanism (4) mounted in the pull handle housing (1*a*) to unlock the lock, wherein the actuation mechanism (4) can be actuated by pulling the handle part (3) and having a coupling element (56) mounted in the pull handle housing (1*a*) to couple with elements arranged outside the pull handle housing (1*a*) to unlock the lock, and a locking mechanism (5) to unlock and lock the actuation mechanism (4), wherein the coupling element (56) is mounted linearly displaceable back and forth in the bearing part (2) in a direction parallel to an actuation axis (209) perpendicular to the swivel axis (170), and connected linearly actuatable to the handle part (3) in an actuation direction (204) parallel to the actuation axis (209), wherein the coupling element (56) is mounted freely rotatable around the actuation axis (209) and otherwise non-rotatable in the bearing part (2).

2. The pull handle (1) according to claim 1, wherein the pull handle (1) includes a means for converting the swivel movement of the handle part (3) into the linearly displaceable movement of the coupling element (56).

3. The pull handle (1) according to claim 1, wherein the actuation mechanism (4) is connected to the locking mechanism (5) in such a manner that the handle part (3) is mechanically decoupled by the coupling element (56), whereby an actuation of the handle part (3) does not cause the coupling element (56) to be actuated after locking of the locking mechanism.

4. The pull handle (1) according to claim 1, wherein the locking mechanism (5) includes a cylinder lock (13) that can be actuated with a key, wherein the cylinder lock (13) has a lock cylinder (24) defining a cylinder axis (51), and having a cylinder core (48) rotatable about the cylinder axis (51) after inserting the key, and spring-loaded disc tumblers (49) arranged therein.

5. The pull handle (1) according to claim 4, wherein the lock cylinder (24) is mounted in the bearing part (2) in a non-displaceable and non-rotatable manner.

6. The pull handle (1) according to claim 4, wherein the locking mechanism (5) includes an adapter pin (52) which is connected to the cylinder core (48) so as not to rotate around the cylinder axis (51).

7. The pull handle (1) according to claim 6, wherein the locking mechanism (5) includes a driving sleeve (53) which is connected to the adapter pin (52) so as not to rotate around the cylinder axis (51), wherein the driving sleeve (53) is arranged around an adapter pin shaft (61) of the adapter pin (52) and is positively connected thereto.

8. The pull handle (1) according to claim 7, wherein the driving sleeve (53) is connected to the cylinder core (48) so as to be drivable in a rotary manner around the cylinder axis (51) from an initial position of the driving sleeve (53) to a locking position of the driving sleeve (53) in a locking direction (202).

9. The pull handle (1) according to claim 7, wherein the locking mechanism (5) includes a latching sleeve (54) which is connected to the driving sleeve (53) so as to be drivable back and forth in a rotary manner around the cylinder axis (51), wherein the driving sleeve (53) and the latching sleeve (54) can rotate by a certain amount relative to each other around the cylinder axis (51).

10. The pull handle (1) according to claim 9, wherein the driving sleeve (53) is connected to the cylinder core (48) so as to be drivable in a rotary manner around the cylinder axis (51) from an initial position of the driving sleeve (53) to a locking position of the driving sleeve (53) in a locking direction (202) and the latching sleeve (54) is connected to the cylinder core (48) so as to be drivable in a rotary manner around the cylinder axis (51) from an initial position of the latching sleeve (54) to a locking position of the latching sleeve (54) in the locking direction (202).

11. The pull handle (1) according to claim 10, wherein the latching sleeve (54) is connected to the cylinder core (48) so as to be drivable in a rotary manner around the cylinder axis (51) from the locking position of the latching sleeve (54) to the initial position of the latching sleeve (54) against the locking direction (202).

12. The pull handle (1) according to claim 10, wherein the latching sleeve (54) includes latching means (90, 92) and the bearing part (2) includes corresponding counter-latching means (33, 36, 37, 38) by means of which the latching sleeve (54) is respectively held in the initial position and the locking position in a latching manner.

13. The pull handle (1) according to claim 12, wherein the latching sleeve (54) latching means including two latching arms (90) which each include a detent (92) on their free end, and the bearing part (2) has a corresponding counter-latching means in the form of an annular latching surface (33) with two locking sections (36) radially opposite each other relative to the cylinder axis (51), wherein each of the locking sections (36) features two locking recesses (37) adjacent to each other in the circumferential direction.

14. The pull handle (1) according to claim 13, wherein the locking mechanism (5) includes a torsion spring (97), which presses the detents (92) into one of the respective locking recesses (37).

15. The pull handle (1) according to claim 9, wherein the actuation mechanism (4) includes a coupling sleeve (55) which is connected to the handle part (3) so as to be linearly movable from a non-actuated to an actuated position in the actuation direction (204).

16. The pull handle (1) according to claim 15, wherein the coupling sleeve (55) is connected to the latching sleeve (54) so as not to rotate around the cylinder axis (51).

17. The pull handle (1) according to claim 15, wherein the coupling sleeve (55) is mounted in the bearing part (2) so as to linearly move back and forth parallel to the actuation axis (209) and rotate around the actuation axis (209).

18. The pull handle (1) according to claim 15, wherein the coupling element (56) is connected to the coupling sleeve (55) so as not to be displaceable parallel to the actuation axis (209).

19. The pull handle (1) according to claim 18, wherein the coupling element (56) is connected to the coupling sleeve (55) so as to be freely rotatable around the actuation axis (209).

20. The pull handle (1) according to claim 15 wherein the coupling sleeve (55) has a coupling sleeve wall (100) with an inner wall area (100*a*) and an outer wall area (100*b*), wherein the coupling sleeve (55) includes two coupling pins (106) which adjoin the outer wall area (100*b*) of the coupling sleeve wall (100), and radially protrude therefrom.

21. The pull handle (1) according claim 20, wherein the two coupling pins (106) are radially opposite to each other relative to a longitudinal coupling sleeve axis (99).

22. The pull handle (1) according claim 20, wherein the coupling pins respectively (106) include a coupling area (107).

23. The pull handle (1) according to claim 22, wherein the coupling areas are generally level and perpendicular to a longitudinal coupling sleeve axis (99).

24. The pull handle (1) according to claim 22, wherein the actuation mechanism (4) includes a driving fork (57) which is connected to the handle part (3) so as not to rotate around the swivel axis (170).

25. The pull handle (1) according to claim 24, wherein the driving fork (57) includes two fork arms (140) which form a receiving area (141) therebetween and respectively have a free actuation end (142).

26. The pull handle (1) according to claim 25, wherein the fork arms (140) are arranged outside around the coupling sleeve (55).

27. The pull handle (1) according to claim 26, wherein the free actuation ends (142) of the fork arms (140) respectively rest in a coupled position of the coupling sleeve (55) on one of the two coupling areas (107), so that the coupling sleeve (55) is connected via the driving fork (57) with the handle part (3) so as to be movable in the actuation direction (204).

28. The pull handle (1) according to claim 27, wherein the free actuation ends (142) of the fork arms (140) are arranged in the coupled position of the coupling sleeve (55) aligned to the coupling areas (107) in the direction of the actuation axis (209).

29. The pull handle (1) according to claim 25 wherein the fork arms (140) are arranged inside the bearing part (2).

30. The pull handle (1) according to claim 25 wherein the driving fork (57) includes a connection shaft (148) which is firmly connected on one end to the two fork arms (140) and firmly connected on the other end to the handle part (3), wherein the connection shaft (148) engages through an opening (16) in the bearing part (2).

31. The pull handle (1) according to claim 1, wherein the coupling element (56) is a coupling pin (56).

32. The pull handle (1) according to claim 31, wherein the actuation mechanism (4) includes a coupling sleeve (55) which is connected to the handle part (3) so as to be linearly movable from a non-actuated to an actuated position in the actuation direction (204) and that the coupling pin (56) defines a longitudinal coupling pin axis (120) coaxial to the actuation axis (209) and is mounted in a coupling sleeve (55) so as to be axially non-movable relative to the longitudinal coupling pin axis (120) and freely rotatable around the longitudinal coupling pin axis (120).

33. The pull handle (1) according to claim 31 wherein the coupling pin (56) partially protrudes from the pull handle housing (1*a*) in the non-actuated position of the handle part (3).

34. A pull handle (1) to unlock a lock of a door or lift-gate, for a vehicle including a construction machine or an agricultural vehicle, comprising:

a pull handle housing (1*a*) having a bearing part (2) for securing on the door or lift gate and a handle part (3) connected to the bearing part (2) so as to swivel around a swivel axis (170), wherein the handle part (3) can be swiveled by pulling it from a non-actuated to an actuated position, an actuation mechanism (4) mounted in the pull handle housing (1*a*) to unlock the lock, wherein the actuation mechanism (4) can be actuated by pulling the handle part (3) and having a coupling element (56) mounted in the pull handle housing (1*a*) to couple with elements arranged outside the pull handle housing (1*a*) to unlock the lock, and a locking mechanism (5) to unlock and lock the actuation mechanism (4), wherein the coupling element (56) is mounted linearly displaceable back and forth in the bearing part (2) in a direction parallel to an actuation axis (209) perpendicular to the swivel axis (170), and connected linearly actuatable to the handle part (3) in an actuation direction (204) parallel to the actuation axis (209), wherein the locking mechanism (5) includes a cylinder lock (13) that can be actuated with a key, wherein the cylinder lock (13) has a lock cylinder (24) defining a cylinder axis (51), and having a cylinder core (48) rotatable about the cylinder axis (51) after inserting the key, and spring-loaded disc tumblers (49) arranged therein, wherein the locking mechanism (5) includes an adapter pin (52) which is connected to the cylinder core (48) so as not to rotate around the cylinder axis (51), a driving sleeve (53) which is connected to the adapter pin (52) so as not to rotate around the cylinder axis (51), wherein the driving sleeve (53) is arranged around an adapter pin shaft (61) of the adapter pin (52) and is positively connected thereto, and a latching sleeve (54) which is connected to the driving sleeve (53) so as to be drivable back and forth in a rotary manner around the cylinder axis (51), wherein the driving sleeve (53) and the latching sleeve (54) can rotate by a certain amount relative to each other around the cylinder axis (51), wherein the driving sleeve (53) is connected to the cylinder core (48) so as to be drivable in a rotary manner around the cylinder axis (51) from an initial position of the driving sleeve (53) to a locking position of the driving sleeve (53) in a locking direction (202) and the latching sleeve (54) is connected to the cylinder core (48) so as to be drivable in a rotary manner around the cylinder axis (51) from an initial position of the latching sleeve (54) to a locking position of the latching sleeve (54) in the locking direction (202), wherein the latching sleeve (54) includes latching means (90, 92) and the bearing part (2) includes corresponding counter-latching means (33, 36, 37, 38) by means of which the latching sleeve (54) is respectively held in the initial position and the locking position in a latching manner, wherein the latching sleeve (54) latching means including two latching arms (90) which each include a detent (92) on their free end, and the bearing part (2) has a corresponding counter-latching means in the form of an annular latching surface (33) with two locking sections (36) radially opposite each other relative to the cylinder axis (51), wherein each of the locking sections (36) features two locking recesses (37) adjacent to each other in the circumferential direction.

35. The pull handle (1) according to claim 34, wherein the locking mechanism (5) includes a torsion spring (97), which presses the detents (92) into one of the respective locking recesses (37).

36. A pull handle (1) to unlock a lock of a door or lift-gate, for a vehicle including a construction machine or an agricultural vehicle, comprising:

a pull handle housing (1*a*) having a bearing part (2) for securing on the door or lift gate and a handle part (3) connected to the bearing part (2) so as to swivel around a swivel axis (170), wherein the handle part (3) can be swiveled by pulling it from a non-actuated to an actuated position, an actuation mechanism (4) mounted in the pull handle housing (1*a*) to unlock the lock, wherein the actuation mechanism (4) can be actuated by pulling the handle part (3) and having a coupling element (56) mounted in the pull handle housing (1*a*) to couple with elements arranged outside the pull handle housing (1*a*) to unlock the lock, and a locking mechanism (5) to unlock and lock the actuation mechanism (4), wherein the coupling element (56) is mounted linearly displaceable back and forth in the bearing part (2) in a direction parallel to an actuation axis (209) perpendicular to the swivel axis (170), and connected linearly actuatable to the handle part (3) in an actuation direction (204) parallel to the actuation axis (209), wherein the actuation mechanism (4) includes a coupling sleeve (55) which is connected to the handle part (3) so as to be linearly movable from a non-actuated to an actuated position in the actuation direction (204).

* * * * *